US010448712B2

(12) United States Patent
Nipke et al.

(10) Patent No.: US 10,448,712 B2
(45) Date of Patent: Oct. 22, 2019

(54) SIZE-ADJUSTABLE FASHION ACCESSORY

(71) Applicant: Michael E. Nipke, LLC, Grand Rapids, MI (US)

(72) Inventors: Michael E. Nipke, Grand Rapids, MI (US); Justin Burton, Grand Rapids, MI (US)

(73) Assignee: Michael E. Nipke, LLC, Grand Rapids, MI (US)

( * ) Notice: Subject to any disclaimer, the term of this patent is extended or adjusted under 35 U.S.C. 154(b) by 379 days.

(21) Appl. No.: 15/219,607

(22) Filed: Jul. 26, 2016

(65) Prior Publication Data

US 2017/0224065 A1 Aug. 10, 2017

Related U.S. Application Data

(60) Provisional application No. 62/290,996, filed on Feb. 4, 2016.

(51) Int. Cl.
*A44C 5/20* (2006.01)
*A44C 15/00* (2006.01)
(Continued)

(52) U.S. Cl.
CPC ..... *A44C 5/2071* (2013.01); *A44C 13/00* (2013.01); *A44C 15/005* (2013.01); *A44C 25/00* (2013.01);
(Continued)

(58) Field of Classification Search
CPC . Y10T 24/1498; A44C 5/2071; A44C 5/0053; A44C 5/0007; A44C 25/00;
(Continued)

(56) References Cited

U.S. PATENT DOCUMENTS 3,542,321 A * 11/1970 Kahabka ..... F16L 3/233 128/DIG. 26
3,886,630 A * 6/1975 Emery ..... B65D 63/1072 24/16 PB
(Continued)

OTHER PUBLICATIONS

International Search Report of the International Searching Authority from corresponding Patent Cooperation Treaty (PCT) Application No. PCT/IB16/54522, indicated completed on Nov. 17, 2016.
(Continued)

*Primary Examiner* — Robert Sandy
*Assistant Examiner* — Rowland Do
(74) *Attorney, Agent, or Firm* — Gardner, Linn, Burkhart & Ondersma LLP

(57) ABSTRACT

A size-adjustable fashion accessory includes an elongated strap having a plurality of catch features, such as raised or depressed features, disposed at spaced locations along a length of the elongated strap. A retainer is disposed at a first end section of the elongated strap that is configured to receive an opposing second end section of the elongated strap to form a loop configuration. The retainer includes an engagement element that resiliently deforms against at least one of the plurality of catch features upon insertion or removal of the second end section, providing a tactile engagement, such as a click or snap, when adjusting the size of the loop configuration. The size-adjustable fashion accessory may include a decorative charm accessory or the like that may be adapted to engage the elongated strap at various locations along its length or at the retainer.

20 Claims, 20 Drawing Sheets

(51) Int. Cl.

| | |
|---|---|
| ***A44C 13/00*** | (2006.01) |
| ***A44C 25/00*** | (2006.01) |
| *A44C 5/00* | (2006.01) |
| *A44C 9/02* | (2006.01) |

(52) U.S. Cl.
CPC ..... *A44C 5/0007* (2013.01); *A44C 5/0053* (2013.01); *A44C 9/02* (2013.01); *A44C 25/007* (2013.01); *A44D 2200/10* (2013.01); *A44D 2211/00* (2013.01)

(58) Field of Classification Search
CPC ..... A44C 25/007; A44C 13/00; A44C 9/02; A44D 2211/00; A44D 2200/10
See application file for complete search history.

(56) References Cited

U.S. PATENT DOCUMENTS

| | | | | |
|---|---|---|---|---|
| 6,032,680 | A | 3/2000 | Lu et al. | |
| 7,819,721 | B1 * | 10/2010 | Messier | A41D 27/08 2/244 |
| 8,262,393 | B2 | 9/2012 | Adams | |
| 9,067,717 | B2 * | 6/2015 | DeMik | B65D 67/02 |
| 10,053,268 | B1 * | 8/2018 | Sickenberger | B65D 63/1063 |
| 2008/0086917 | A1 | 4/2008 | Carrillo | |
| 2010/0302914 | A1 | 12/2010 | Faucher et al. | |
| 2013/0074545 | A1 | 3/2013 | Moloney | |
| 2014/0165339 | A1 * | 6/2014 | Yuan | B65D 63/1072 24/16 PB |
| 2014/0290015 | A1 | 10/2014 | Barron | |
| 2016/0355310 | A1 * | 12/2016 | Rogers | B65D 63/1072 |

OTHER PUBLICATIONS

Written Opinion of the International Searching Authority from corresponding Patent Cooperation Treaty (PCT) Application No. PCT/IB16/54522, indicated completed on Nov. 17, 2016.
KSS Wiring Accessories Catalog, Published in 2016.
Creativity for Kids by Faber-Castell, Tassel Bracelets, believed to have been made publicly available on Jan. 13, 2015.
Horizon Group U.S.A, It's So Me! Word Wear Jewelry and Bracelet Making Kit, believed to have been made publicly available in 2015.
Melissa and Doug, Design-Your-Own Bracelets, believed to have been publicly available prior to Feb. 13, 2013.
Melissa and Doug, Design-Your-Own Rings, believed to have been publicly available prior to May 14, 2015.
American Girl, Ultimate Crafting Kit, believed to have been made publicly available on Aug. 13, 2015.

* cited by examiner

SIZE-ADJUSTABLE FASHION ACCESSORY

CROSS REFERENCE TO RELATED APPLICATION

The present application claims priority of U.S. provisional application, Ser. No. 62/290,996 filed Feb. 4, 2016, by Nipke et al. for a SIZE-ADJUSTABLE FASHION ACCESSORY, which is hereby incorporated herein by reference in its entirety.

FIELD OF THE INVENTION

The present invention relates generally to the field of fashion accessories, and more particularly to adjustable and customizable fashion accessories.

BACKGROUND OF THE INVENTION

Fashion accessories, such as bracelets and necklaces, are commonly secured in an adjustable loop with a clasp that can be releasably attached at multiple locations. However, these accessories can be difficult to adjust, such as for children, due to the difficulty of disengaging and reengaging a clasp while simultaneously holding the accessory at the desired position.

SUMMARY OF THE INVENTION

The present invention provides a size-adjustable fashion accessory that may be worn as a bracelet, bangle, necklace, ring, or other loop configuration. In accordance with one aspect of the present invention, a size-adjustable fashion accessory includes an elongated strap having a plurality of catch features, such as raised or depressed features, disposed at spaced locations along a length of the elongated strap. A retainer is disposed at a first end section of the elongated strap that is configured to receive an opposing second end section of the elongated strap to form a loop configuration. The retainer includes an engagement element that resiliently moves away from the elongate strap upon insertion and removal of the second end section relative to the retainer and resiliently moves toward the elongated strap to engage at least one of the plurality of catch features. The engagement element provides a tactile engagement, such as a click or snap, when adjusting the size of the loop configuration and allows the elongated strap to be completely removed from the retainer and also reengaged in the loop configuration in a smaller or larger sized configuration.

Optionally, the size-adjustable fashion accessory may include an attachable decorative piece having a base portion that is adapted to engage the elongated strap at various locations along its length. Also, the retainer may optionally include an attachment feature that is adapted to engage an attachable decorative piece, such that the size of the loop configuration may be adjusted with the decorative piece attached at the retainer. Accordingly, another aspect of the present invention provides a fashion accessory kit with various size-adjustable fashion accessories and attachable decorative pieces, such as charms, pendants, and decorative stickers for applying to designated surfaces of the decorative pieces. The size-adjustable fashion accessory and associated decorative pieces are designed in a manner that is easy to use, adjust, and customize for individuals with poor or developing dexterity, such as children.

These and other objects, advantages, purposes and features of the present invention will become apparent upon review of the following specification in conjunction with the drawings.

DESCRIPTION OF THE PREFERRED EMBODIMENTS

Figure 10:
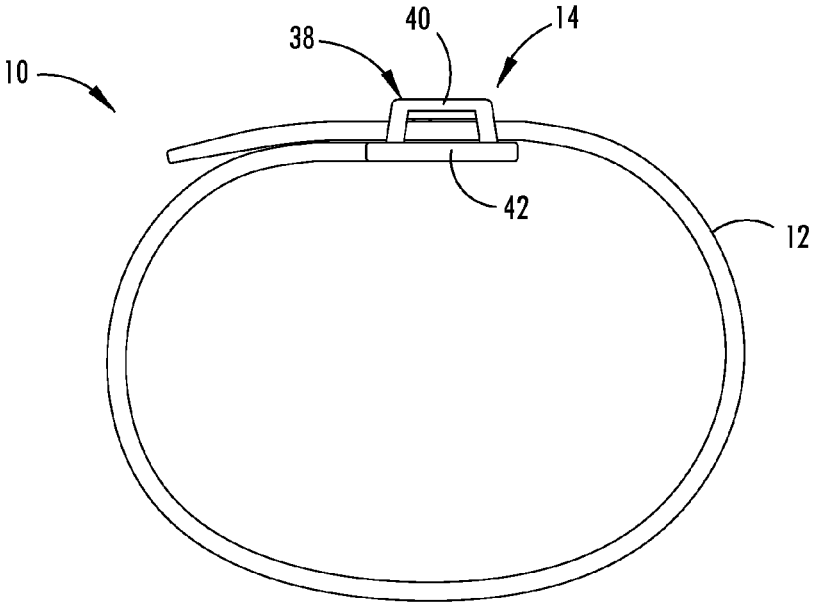
FIG. 10 is a side elevational view of the size-adjustable fashion accessory shown in FIG. 2, illustrating it engaged in a loop configuration.
Figure 19:
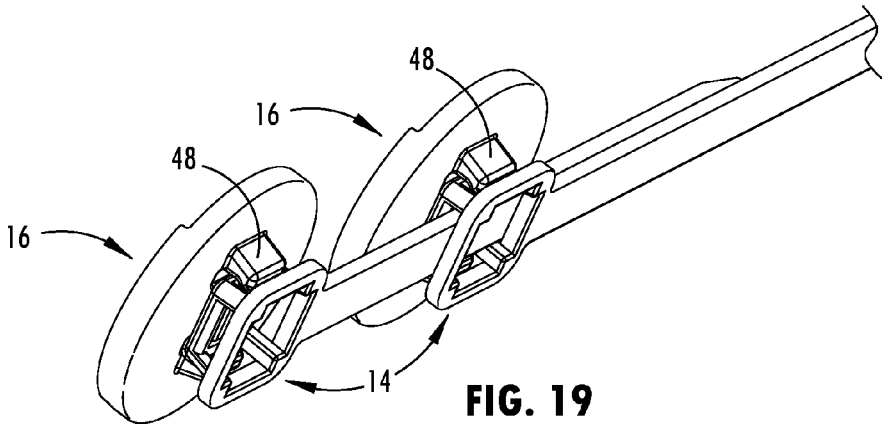
FIG. 19 is a rear upper perspective view of the size-adjustable fashion accessories shown in FIG. 14.

Referring now to the drawings and the illustrative embodiments depicted therein, a size-adjustable fashion accessory 10 includes an elongated band portion or strap 12, a retainer 14, and, optionally, one or more decorative pieces 16, such as charms 16*a*, pendants 16*b*, hangers 16*c*, tassels 16*d*, buckles 16*e*, or the like, that attach to the strap 12 (FIG. 20) and/or the retainer 14 (FIG. 19). The retainer 14 is generally arranged at one end of the elongated strap 12 and is configured to receive an opposing end of the elongated strap 12 to form a loop or ring configuration, such as shown in FIG. 10. The elongated strap 12 is shown with a plurality of catch features 18 disposed at spaced locations along a length of the elongated strap 12. These catch features 18 may be depressions, such as cavities, or raised features, or the like that are configured to engage or interface with the retainer 14 in a releasable manner for allowing the size of the loop to easily be adjusted, either withdrawing the end section of the strap 12 from the retainer 14 for expanding the size of the loop or further inserting the end section of the strap 12 into the retainer 14 for contracting the size of the loop.

Figure 1A:
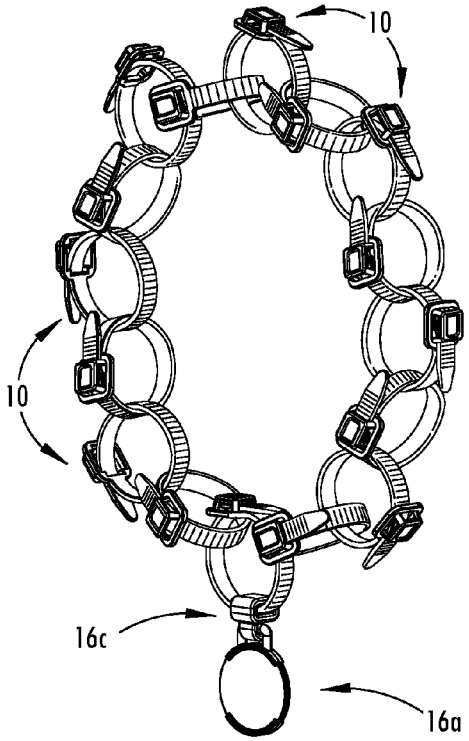
FIGS. 1A-1D are a perspective views of various size-adjustable fashion accessories and associated charm accessories, in accordance with the present invention.
Figure 1B:
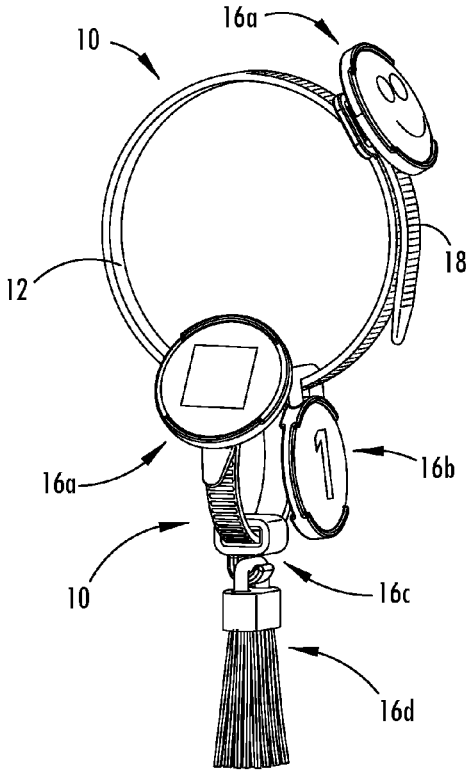
Figure 1C:
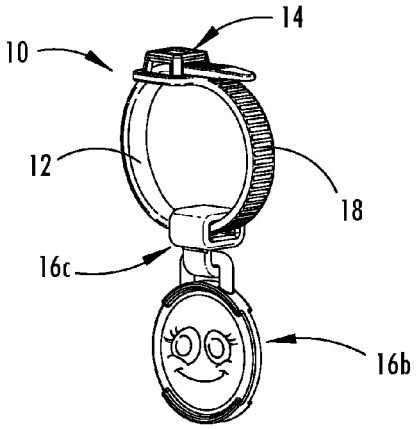
Figure 1D:
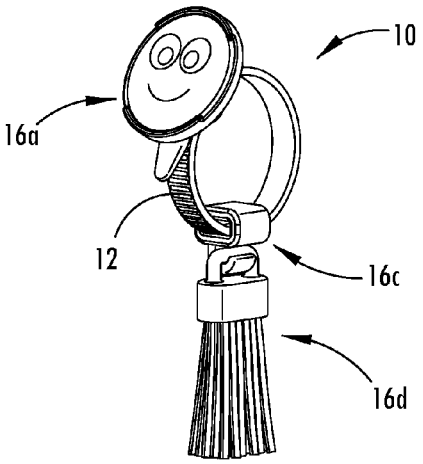
Figure 2:
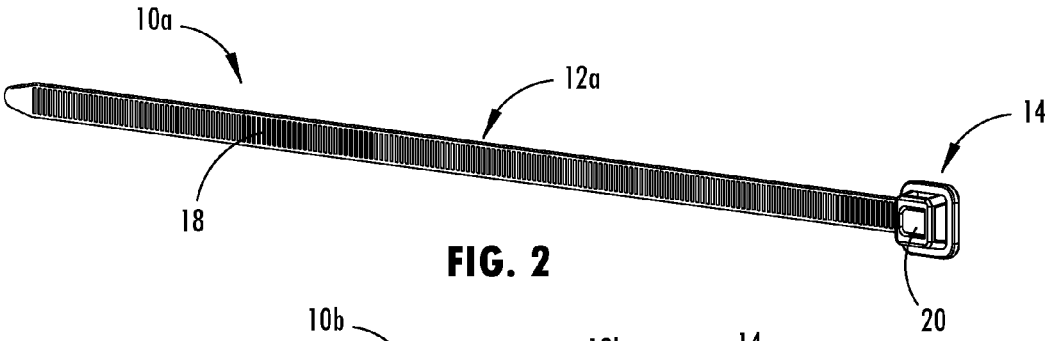
FIG. 2 is an upper perspective view of a size-adjustable fashion accessory, as illustrated in an attached loop in FIG. 1B.
Figure 3:
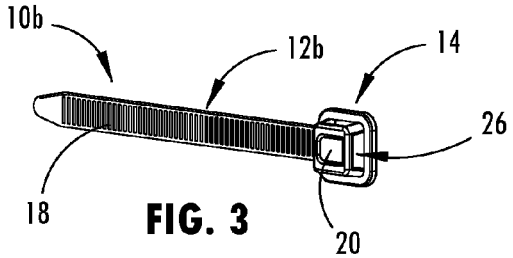
FIG. 3 is an upper perspective view of a size-adjustable fashion accessory, as illustrated in an attached loop in FIG. 1C.
Figure 14:
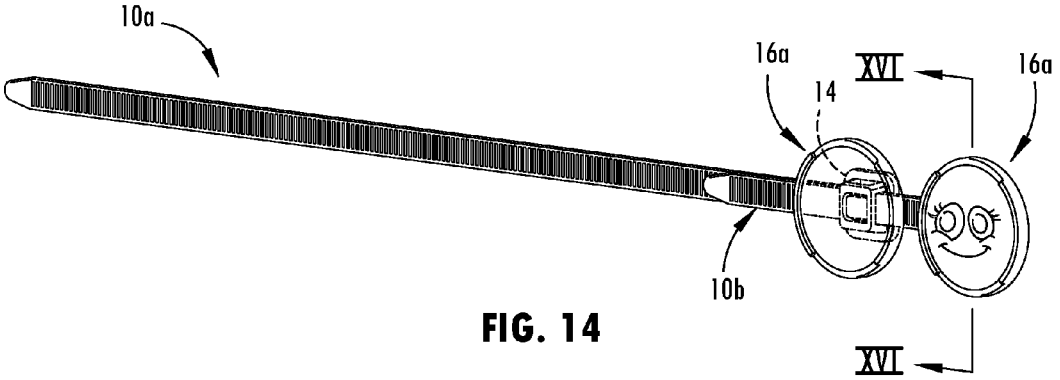
FIG. 14 is an upper perspective view of the size-adjustable fashion accessories shown in FIG. 11, with charms attached at the retainers of each size-adjustable fashion accessory.
Figure 15:
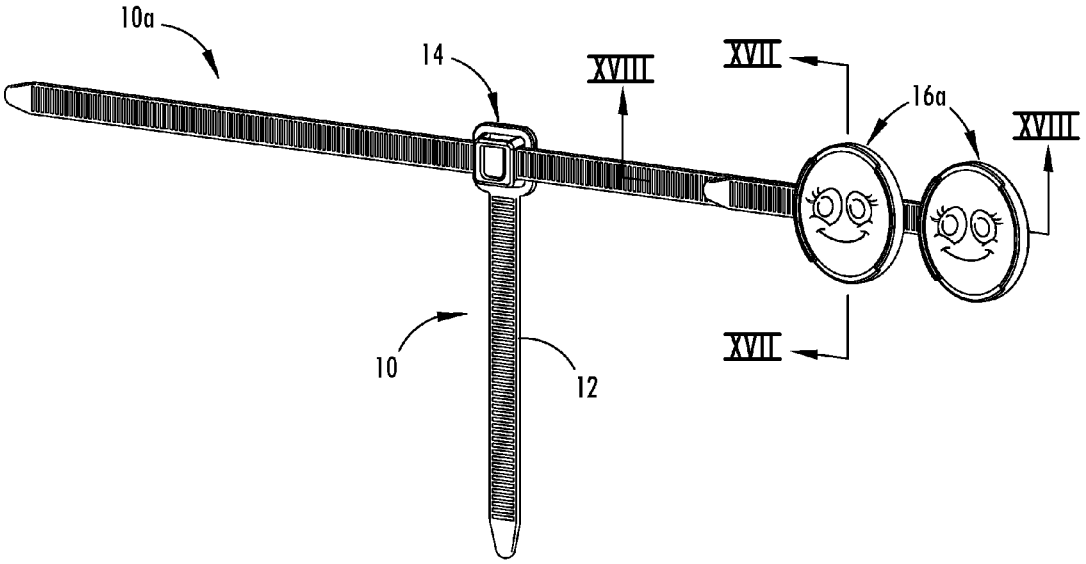
FIG. 15 is an upper perspective view of the size-adjustable fashion accessories shown in FIG. 14, with an additional size-adjustable fashion accessory engaged perpendicularly to show a perpendicular linking arrangement.
Figure 16:
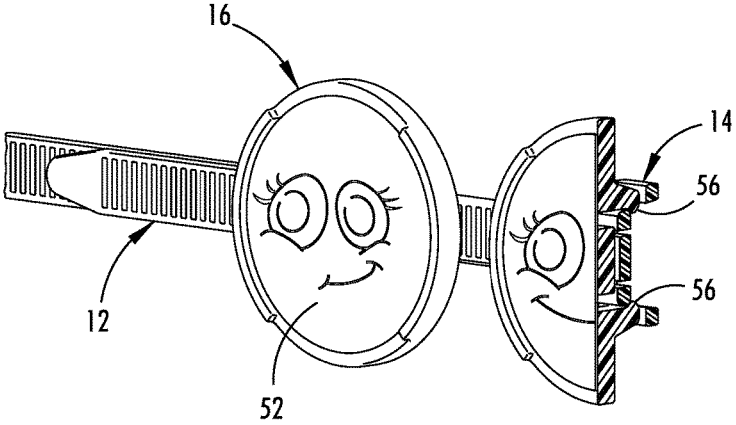
FIG. 16 is an upper perspective cross-sectional view taken at line XVI-XVI of the charm engaged with the size-adjustable fashion accessory shown in FIG. 14.
Figure 16A:
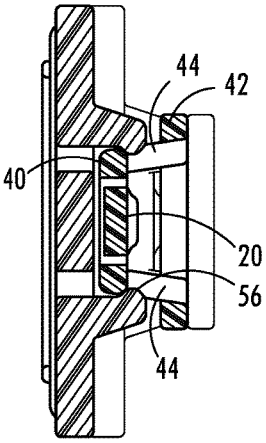
FIG. 16A is an end cross-sectional view taken at line XVI-XVI of the charm engaged with the size-adjustable fashion accessory shown in FIG. 14.
Figure 17:
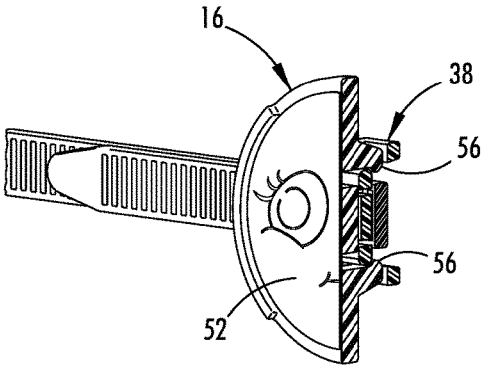
FIG. 17 is an upper perspective cross-sectional view taken at line XVII-XVII of the charm engaged with the size-adjustable fashion accessory shown in FIG. 15.
Figure 17A:
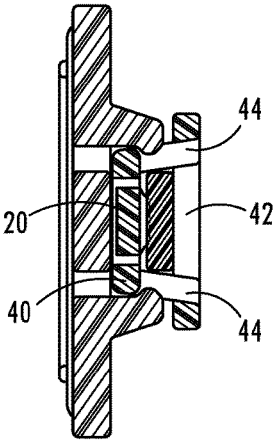
FIG. 17A is an end cross-sectional view taken at line XVII-XVII of the charm engaged with the size-adjustable fashion accessory shown in FIG. 15.
Figure 18:
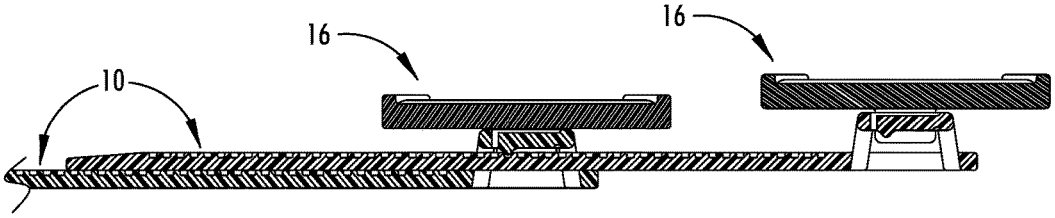
FIG. 18 is a side cross-sectional view taken at line XVIII-XVIII along the length of the of the size-adjustable fashion accessories shown in FIG. 15.

The strap 12 may be various lengths, such as a longer length strap 12*a* (FIG. 2) configured to form a loop around a wrist like a bracelet or a shorter length strap 12*b* (FIG. 3) configured to form a loop around a finger like a ring. Also, as shown in FIG. 14, straps may be linked in a parallel linking arrangement to extend the overall length of the interconnected fashion accessories 10*a*, 10*b*. As shown in FIGS. 1A-1D, the size-adjustable fashion accessory may be provided as a kit that is capable of being arranged in various decorative configurations, such as with multiple shorter straps capable of being connected together in a chain that can form a bracelet or necklace or the like (FIG. 1A), or with one or more decorative pieces 16, such as charms 16*a*, pendants 16*b*, hangers 16*c*, tassels 16*d*, buckles 16*e*, or the like, that can engage the strap at various locations along its length and/or engage the retainer 14 to customize the fashion accessory 10 as desired. Further, as shown in FIG. 15, a retainer 14 may receive a strap of a fashion accessory 10*a* in a perpendicular linking arrangement to provide additional customization capability.

Figure 4:
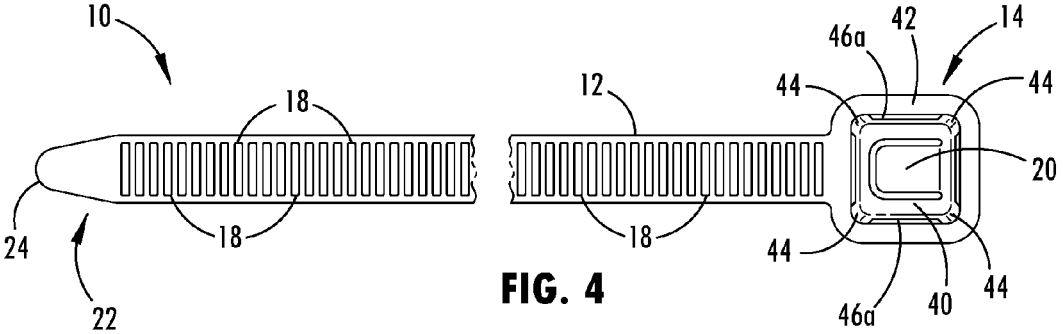
FIG. 4 is a top plan view of a size-adjustable fashion accessory.
Figure 5:
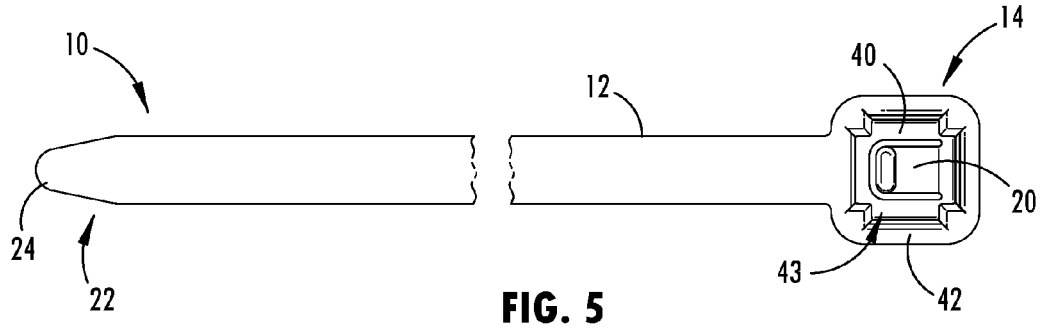
FIG. 5 is a bottom plan view of the size-adjustable fashion accessory shown in FIG. 5.
Figure 6:
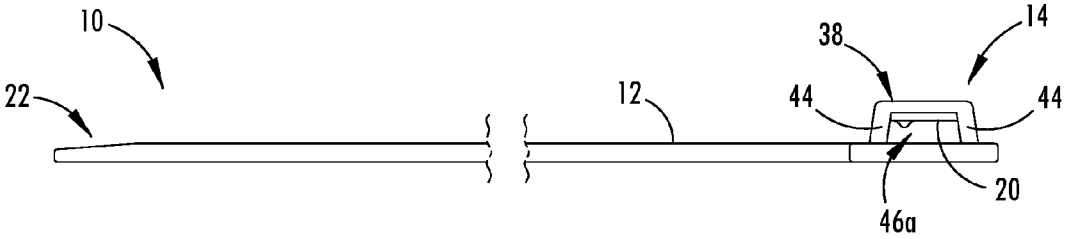
FIG. 6 is a side elevational view of the size-adjustable fashion accessory shown in FIG. 5.
Figure 7:
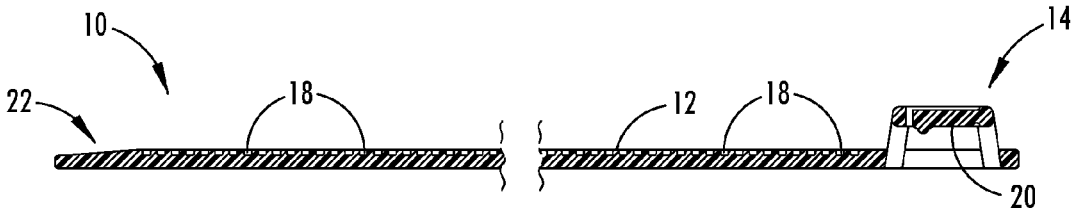
FIG. 7 is a side cross-sectional view taken along the length of the of the size-adjustable fashion accessory shown in FIG. 5.
Figure 13:
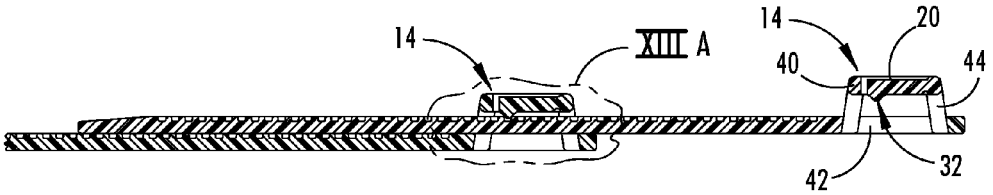
FIG. 13 is a side cross-sectional view taken along the length of the of the size-adjustable fashion accessories shown in FIG. 11.
Figure 13A:
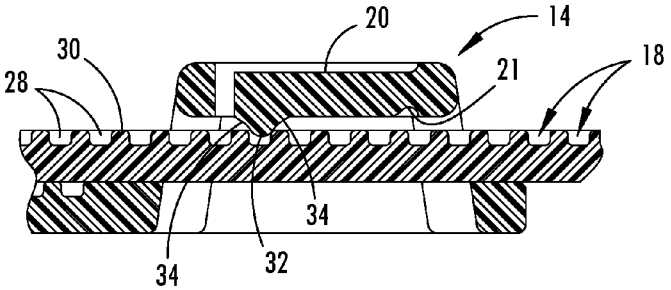
FIG. 13A is an enlarged view taken at section XIII A of the a size-adjustable fashion accessories shown in FIG. 13.
Figure 13B:
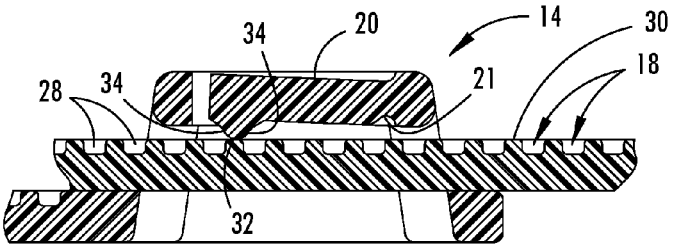
FIG. 13B is a side cross-sectional view with the engaged size-adjustable fashion accessories shown in FIG. 13A, moved relative to each other to cause movement of an engagement element of the retainer.

The retainer 14 of the size-adjustable fashion accessory 10 is disposed at the strap and configured to engage and retain the strap, such as in a loop configuration, and/or to engage and retain additional decorative pieces, such as charms or the like. The illustrated retainer 14, as shown in FIGS. 4-6, is integrally formed at the end of the strap 12 to provide a single piece. The retainer 14 includes an engagement element 20, as shown in FIGS. 13A-13B, that resiliently deforms or flexes when at least one of the plurality of catch features 18 is moved against the engagement element 20, such as upon insertion or withdrawal of the opposing end section of the elongated strap 12 from the retainer 14. Upon resiliently deforming or flexing the engagement element 20 outward away from the elongated strap 12 (FIG. 13B), the catch feature 18 that is interfacing with and providing the force against the engagement element 20 is permitted to move past the engagement element 20, whereby the engagement element 20 then resiliently moves inward toward the elongated strap 12 and reengages another one of the catch features 18 (FIG. 13A). This disengagement and reengagement by the flexing of the engagement element 20 provides a tactile response associated with adjusting the size of the loop configuration, such as with a snapping or clicking sound and feel against each catch feature 18 that passes by the engagement element 20.

Accordingly, after engaging a strap 12 in the retainer 14, such as when forming a loop configuration (FIG. 10), the engaged connection may be adjusted in two directions, such as to adjust the loop configuration to a larger size by partially withdrawing the elongated strap 12 from the retainer 14 or to a smaller size by further inserting the strap 12 into the retainer. Moveable adjustment in both direction causes the engagement element 20 to move or pivot upward, such as by elastic deformation of the engagement element 20 about a living hinge 21 (FIG. 13B), so as to allow at least one catch features 18 to move past the retainer 14 and then to move downward and resiliently reengage another one of the catch features 18. Thus, the retainer does not lock the strap 12 in either movement direction or otherwise prohibit adjustable movement of the strap relative to the retainer.

Although the retainer 14 and the engagement element 20 preferably provide the resiliency and flexibility to allow adjustments to be made in such a tactile manner, it is also contemplated that the catch features 18 may additionally or alternatively be adapted to resiliently flex when moving relative to the retainer 14. In such an embodiment, the catch feature would resiliently deform and flex for adjustably holding the elongated strap 12 in the loop configuration. To allow for such flexibility and resiliency, it is contemplated that the size-adjustable fashion accessory 10 is made of polypropylene, although it may additionally or alternatively comprise a nylon material, such as Nylon 6/6 and/or other thermoplastic polymeric materials and the like. And further, the size-adjustable fashion accessory 10 may additionally or alternatively comprise an elastomeric or rubbery material to provide added flexibility at the strap for improved comfort and wearability.

As shown in FIGS. 2-7, the elongated strap 12 is provided with catch features 18 that are arranged in a substantially continuous spaced pattern from the retainer 14 to a tip section 22 at the end portion of the elongated strap 12. The catch features 18 may be provided at sections along the length of the strap 12 that are desired for engagement, such as near an end section of the strap and at an intermediate section of the strap 12 for engaging the retainer 14 and/or a decorative pieces, as shown for example in FIGS. 10, 15, and 59. Accordingly, the illustrated strap 12 includes the catch features disposed in the closely spaced pattern over the substantial entire upper or outer surface of the strap 12. However, it is contemplated that the catch features may be omitted from certain sections of the strap and/or arranged at different surfaces from the upper surface on some sections of the strap, such as to engage different decorative pieces or retainers. For example, the catch features may be additionally or alternatively disposed on an inward facing surface or an edge surface of the elongated strap.

Figure 8:
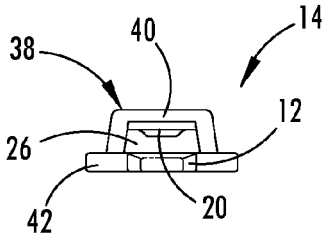
FIGS. 8 and 9 are opposing end elevational views of the size-adjustable fashion accessory shown in FIG. 5.
Figure 9:
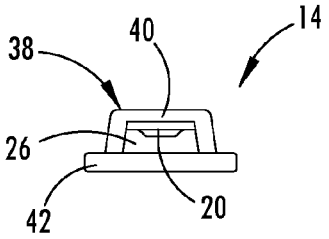

The tip section 22 of the strap 12 is shown in FIGS. 2-5 has a tapered width that terminates in a rounded point 24. The thickness of the elongated strap may similarly taper at the tip section 22, such as shown in FIGS. 6-10. The tip section 22 has such a tapered shaped to allow for relatively simple insertion into a passage 26 that is defined by the structure of the retainer 14, such as shown in FIGS. 8 and 9. It is conceivable that the tip section may have various alternative shapes and may also include the catch features in additional embodiments. It is also understood that the elongated strap may include various cross-sectional shapes in addition to the generally rectangular cross-sectional shape provided in the illustrated embodiments.

Figure 11:
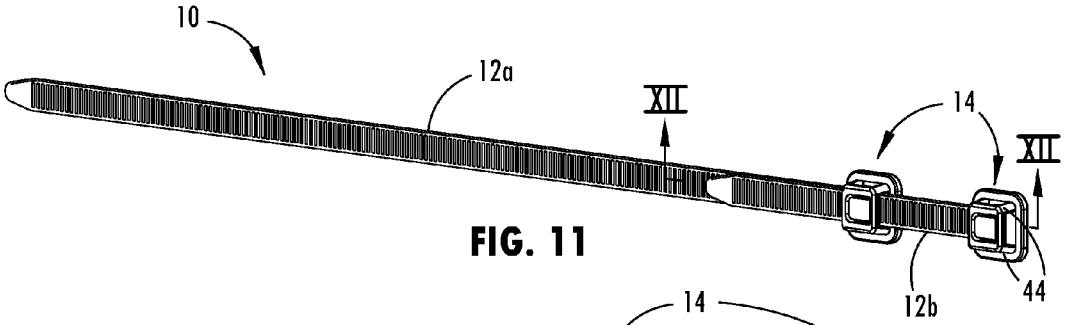
FIG. 11 is an upper perspective view of the size-adjustable fashion accessories shown in FIGS. 2 and 3, with a strap or band portion of the shorter version engaged with the retainer of the longer version in alignment with the strap or band portion of the longer version to show a parallel linking arrangement.
Figure 12:
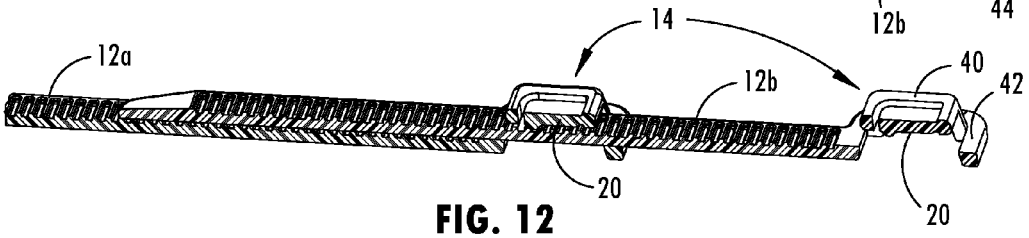
FIG. 12 is an upper perspective cross-sectional view taken along the length of the of the size-adjustable fashion accessories shown in FIG. 11.

Upon inserting the tip section 22 into and through the retainer 14, the engagement element 20 of the retainer 14 is moved into engagement with the catch features 18 to form the loop configuration (FIG. 10). As illustrated in FIGS. 11-13, one of the catch features 18 is engaged by the retainer 14. To provide the positive and tactile engagement, the catch features 18 and engagement element 20 are shaped to matably engage one another. The illustrated catch features 18 each include a cavity 28 that has a generally rectangular shape with a length of the rectangular shape spanning laterally across the strap 12 in general alignment with the width of the strap 12. The cavities 28 also each have a depth that is shaped with a generally square cornered bottom portion (FIGS. 13A and 13B). The spacing between the cavities of each catch feature 18 defines laterally extending ribs 30 that are overcome when moving the engagement element along the strap between different cavities 28. As such, it is contemplated that the cavities may also extend entirely through the strap or may be provided with different depths, as long as the ribs between the cavities are sufficiently rigid to withstand forces with the engagement element to allow the engagement element to resiliently flex and move along the strap 12. The shape, thickness, and/or material that forms the catch features 18 may thereby be changed (and even made asymmetrical) from the illustrated embodiment to adjust resistance and tactile feedback when engaging the engagement element.

Accordingly, as further shown in FIGS. 13-13B, to provide matable engagement with the retainer 14, a detent portion 32 of the engagement element 20 protrudes downward in a generally convex shape to enter the cavity 28 of the catch feature 18. Each side of the detent portion 32 includes a ramped surface 34 that leads toward a centrally located bulbous protrusion 36, which has a rounded shape for engaging the cavity 28. The ramped surface 34 thereby limits the depth that the protrusion 36 is capable of engaging the cavity 28, such that the protrusion 36 is capable of moving more easily relative to the cavities 28 on the strap 12. Upon moving the strap 12 relative to the retainer 14, the rounded shape of the bulbous protrusion 36 slides along the upper corner or edge of the adjacent rib 30 to urge the engagement element 20 upward and away from cavity 28, thereby removing the detent portion 32 from the cavity 28 and allowing the detent to move over the adjacent rib into the to the adjacent cavity. The ramped surface 34 thus may prevent over-insertion of the bulbous protrusion 36 into the cavity, thereby acting to facilitate the sliding movement of the strap 12 relative to the retainer 14. The ramped surfaces 34 of the detent portion 32 are also provided to interface with the end of the tip section 22 of the strap 12. Movement of the tip section 22 along the ramped surfaces 34 similarly raises or flexes the engagement element to move the detent portion 32 up for allowing the tip section 22 to move beyond the retainer 14. The shape, thickness, and/or material that forms the engagement element 20 may thereby be changed (and even made asymmetrical) from the illustrated embodiment to adjust resistance and tactile feedback when engaging the catch features.

The illustrated retainer 14 shown in FIGS. 2-20 includes a catch housing or housing structure 38 with an upper member 40 that includes the engagement element 20. The upper member 40 is spaced from a lower or base member 42 to generally defines the passage 26 that is configured to receive the elongated strap 12 to form the loop configuration (FIG. 10). The lower or base member 42 of the illustrated housing structure 38 is generally aligned with the longitudinal extent of the elongated strap 12, such that the end section of the strap 12 that extends through the retainer 14 may overlay the section of the strap adjacent to the retainer 14, such as shown in FIG. 10. By overlaying the strap on the outer side of the loop configuration several advantages are provided, opposed to the strap overlaying inside the loop configuration. For example, the outside strap overlay allows for adjustments to smaller sized loops (without the strap curling in on itself as it would if providing as an inside strap overlay), easier adjustments by grasping and moving the section of strap overlay outside the loop configuration, and a more comfortable fit by locating the housing of the retailer outside the loop, so that the housing is not resting against a wearer's skin, which could cause irritation. The upper member 40 of the illustrated housing structure 38 is supported at the spaced distance away from the lower member 42 by four corner supports 44 that extend between the upper and lower members 40, 42 on opposing sides of the passage 26 (FIG. 6). The lower member 42 has a central opening 43 (FIG. 5) that is provided to reduce material used in forming (such as injection molding) the retainer 14 portion of the size-adjustable fashion accessory 10. The illustrated passage 26 is thereby bounded by the upper and lower members and the corner supports of the housing structure 38. The engagement element 20 is attached at a single side of a peripheral portion of the upper member 40 and generally protrudes down into the passage 26. Thus, as shown in FIG. 4, generally three sides of the peripheral portion of the upper member 40 is not attached to the engagement element, so as to provide with increased flexibility of the engagement element 20 relative to housing structure 38. Also, the illustrated engagement element is provided with a living hinge to improve resilient flexibility by a notch that is formed at a lower surface of the engagement element near the peripheral portion of the upper member.

Optionally, the engagement element may protrude down from an opposite end of the upper member and may have additional shapes and configurations to provide the flexible and resilient movement of the detent portion into and out of engagement with the catch features. It is envisioned that a tensile force of at least approximately 5 to 10 lbf is desirable to adjust the position of the elongated strap 12 relative to retainer 14. Accordingly, the amount of required force can, for example, be adjusted or altered as desired by changing the configuration, shape, thickness, and/or material that forms the catch features and/or engagement element.

Figure 19A:
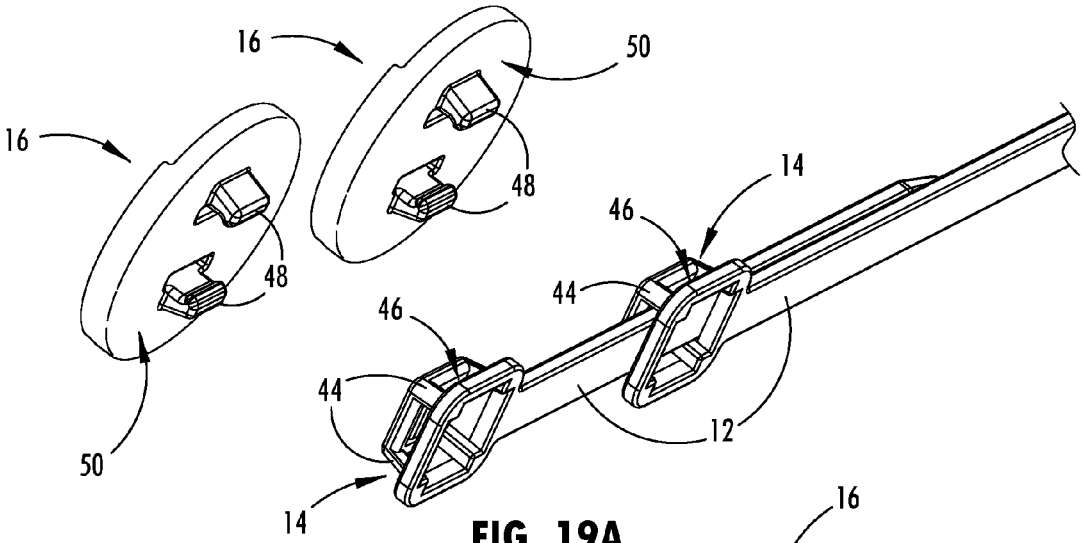
FIG. 19A is a rear upper perspective view of the size-adjustable fashion accessories shown in FIG. 19 with the charms exploded or removed from the retainer of each size adjustable fashion accessory.
Figure 20:
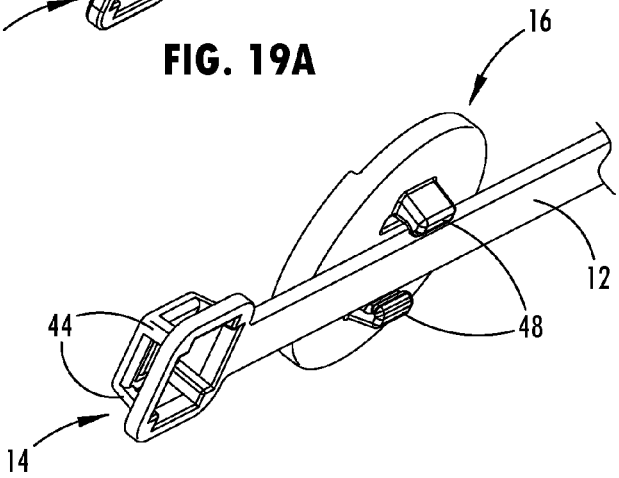
FIG. 20 is a rear upper perspective view of a size-adjustable fashion accessory with a charm engaged at a band portion thereof.
Figure 21:
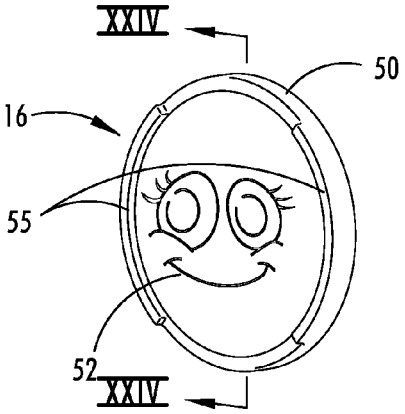
FIG. 21 is an upper perspective view of a charm.
Figure 21A:
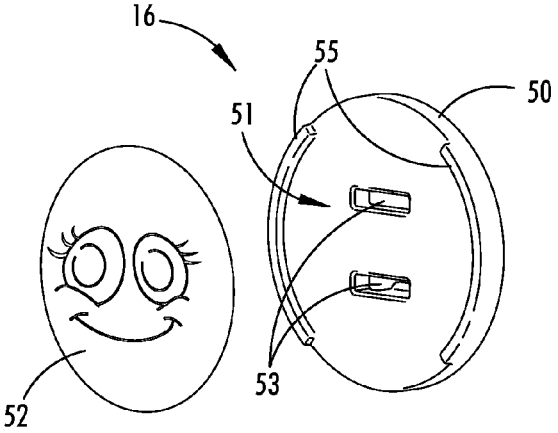
FIG. 21A is an upper perspective view of the charm shown in FIG. 21, having a sticker exploded from a face surface of the charm.
Figure 22:
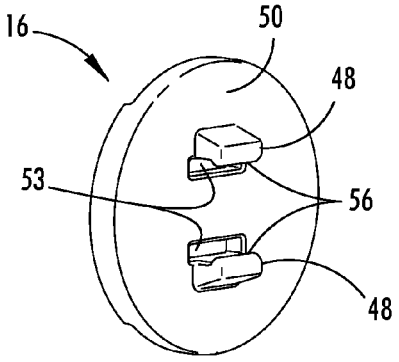
FIG. 22 is a rear upper perspective view of the charm shown in FIG. 21.

Referring now to FIGS. 14-20, the size-adjustable fashion accessory 10 of the present invention may optionally include one or more decorative pieces 16 that attach at the strap 12 or the retainer 14, allowing for simple customization of the size-adjustable fashion accessory 10. In one example, as shown in FIGS. 16-19, a decorative piece 16 may attach at the retainer 14, such as at an attachment feature 46 on the retainer 14 shown provided at the lateral openings 46*a* of the retainer 14 that is adapted to engage one or more charms. In such an embodiment, the loop configuration may be size adjustable with the charm attached. As shown in FIG. 6, the housing structure 38 of the retainer 14 includes lateral openings 46*a* between the corner supports 44 to engage or receive legs 48 that protrude from a bottom surface of the base portion 50 of a charm 16*a* (FIG. 19A). An ornamental addition may attach at the face surface 51 of the base portion 50 of the charm, such as a decorative disc-shaped sticker 52 with a domed upper surface, as shown in FIGS. 21-21A. Such an ornamental addition or portion may also be integrally formed, insert molded, or provided on the base portion, or may otherwise be integrated with the charm.

Figure 23:
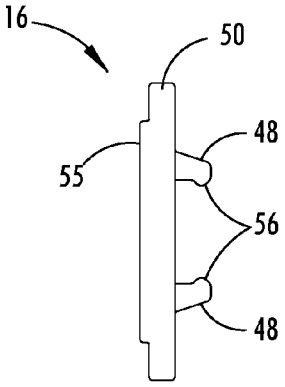
FIG. 23 is an elevational view of the charm shown in FIG. 21.
Figure 24:
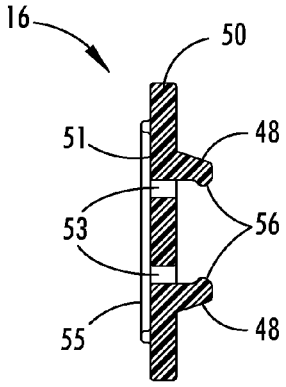
FIG. 24 is a cross-sectional view taken at line XXIV-XXIV of the charm shown in FIG. 21.
Figure 25:
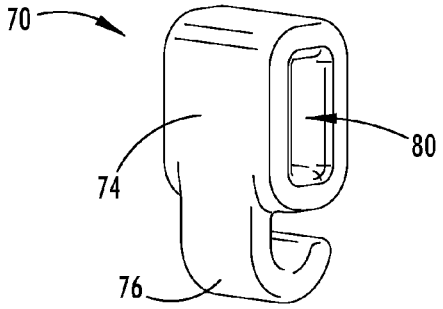
FIG. 25 is an upper perspective view of a hanger.
Figure 26:
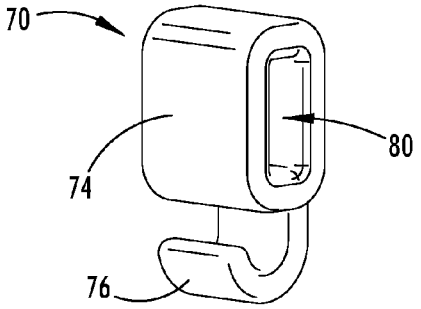
FIG. 26 is a rear upper perspective view of the hanger shown in FIG. 25.

As shown in FIGS. 21-24, the exemplary embodiment of the base portion 50 of the charm 16*a* is illustrated in additional detail. Specifically, the base portion 50 is shown having a pair of apertures 53 extending between the face surface 51 and the bottom surface and arranged adjacent to the legs 48. The apertures 53 are provided, for example, to assist with single phase injection molding of the charm. As shown in FIG. 23, the legs 48 have inward extending features 56 at the lower end portions of the legs 48. The inward extending features 56 may function to both engage the retainer 14, such as shown in FIG. 19, and to engage the edge portions of an intermediate section of the elongated strap 12, such as shown in FIG. 20. When engaging the strap, the inward extending features 56 of the legs engage both the side surface of the strap 12 and the lower surface along the edge of the strap 12. The upper surface of the strap 12, may be engaged by the engagement detent 54 that is shaped similar to the detent portion 32 of the engagement element 20. Accordingly, the charm 16*a* may be slidably moved relative to the length of the elongated strap. The loop configuration may also be size adjustable with the charm attached to the strap 12, although the adjustment may also cause the charm to move along the strap due to contact with the retainer.

Figure 27:
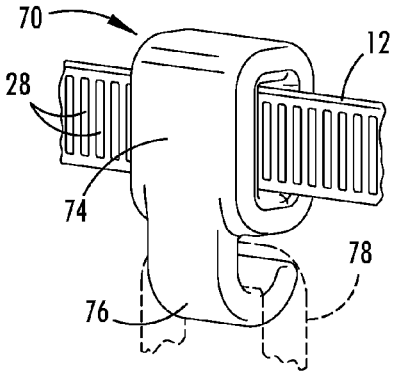
FIG. 27 is an upper perspective view of the hanger shown in FIG. 25 engaged with a band portion of a size-adjustable fashion accessory and holding an additional decorative piece.
Figure 27A:
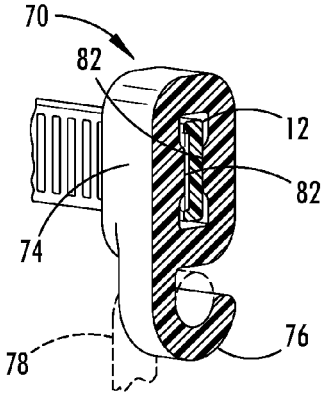
FIG. 27A is an upper perspective cross-sectional view of the hanger shown in FIG. 27.
Figure 28:
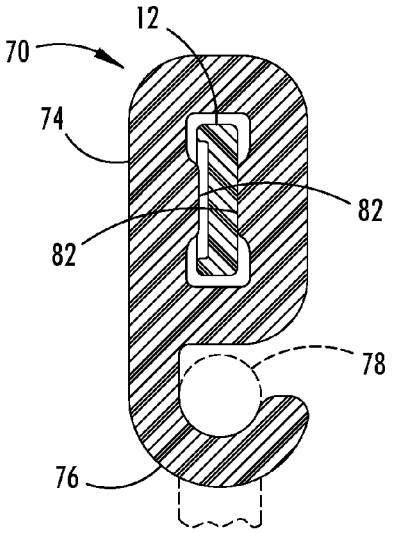
FIG. 28 is a cross-sectional view of the hanger shown in FIG. 27, taken transverse to the length of the engaged band portion of the size-adjustable fashion accessory.
Figure 29:
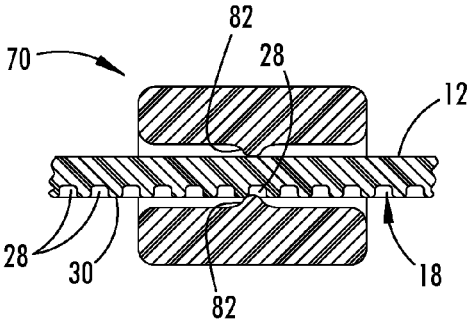
FIG. 29 is a cross-sectional view of the hanger shown in FIG. 27, taken along the length of the engaged band portion of the size-adjustable fashion accessory.
Figure 30:
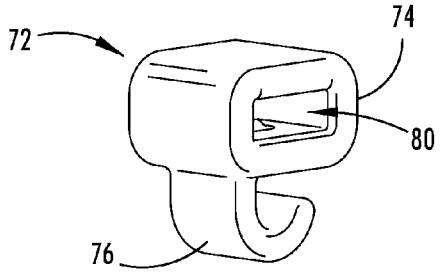
FIG. 30 is an upper perspective view of an additional hanger.
Figure 31:
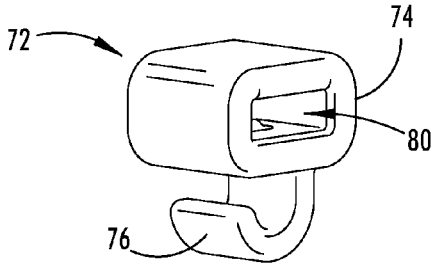
FIG. 31 is a rear upper perspective view of the hanger shown in FIG. 30.
Figure 32:
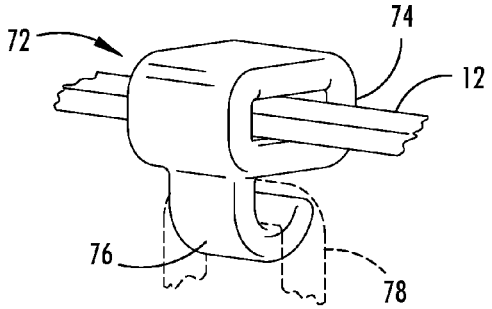
FIG. 32 is an upper perspective view of the hanger shown in FIG. 30 engaged with a band portion of a size-adjustable fashion accessory and holding an additional decorative piece.
Figure 32A:
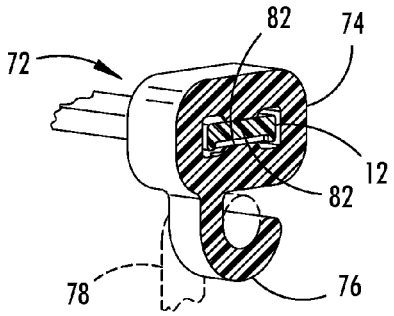
FIG. 32A is an upper perspective cross-sectional view of the hanger shown in FIG. 32.
Figure 33:
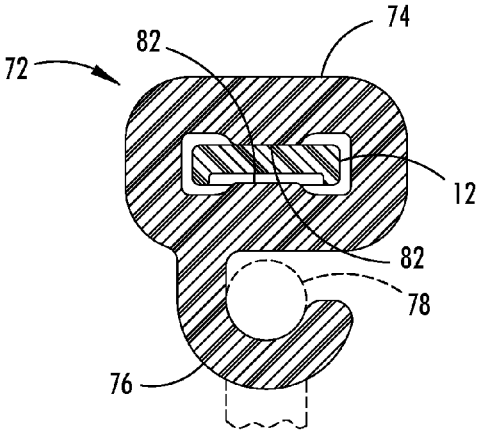
FIG. 33 is a cross-sectional view of the hanger shown in FIG. 32, taken transverse to the length of the engaged band portion of the size-adjustable fashion accessory.
Figure 34:
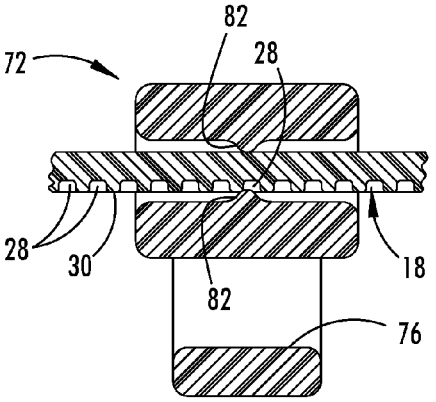
FIG. 34 is a cross-sectional view of the hanger shown in FIG. 32, taken along the length of the engaged band portion of the size-adjustable fashion accessory.
Figure 35:
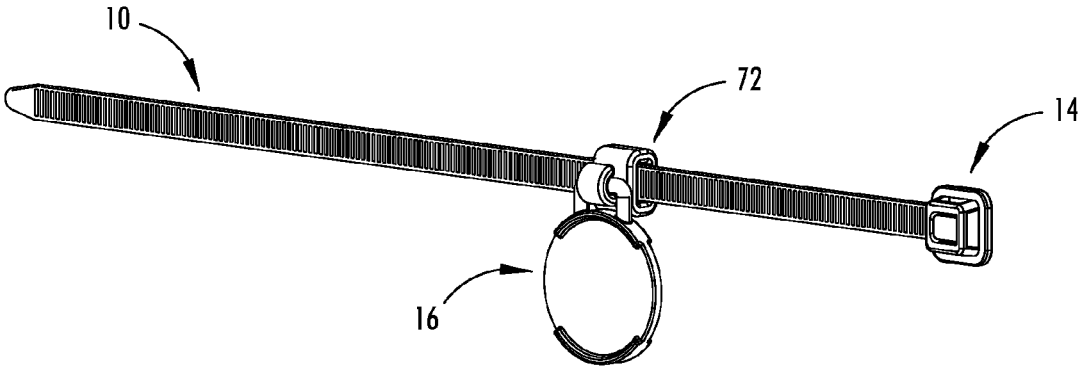
FIG. 35 is an upper perspective view of a size-adjustable fashion accessory having a hanger engaged with a band portion thereof and supporting a pendant.
Figure 36:
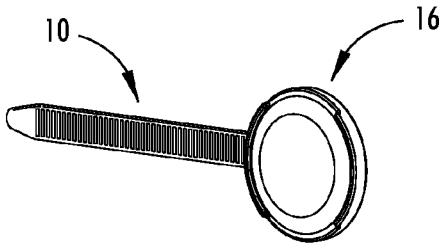
FIG. 36 is an upper perspective view of a size-adjustable fashion accessory having a charm engaged with a retainer thereof.
Figure 37A:
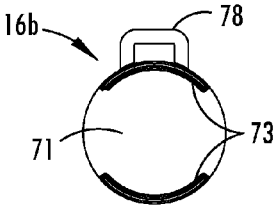
FIGS. 37A-37D are a plan, a perspective, and elevational views of a circular-shaped pendant.
Figure 37B:
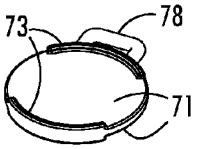
Figure 37C:
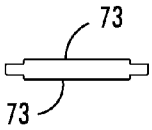
Figure 37D:
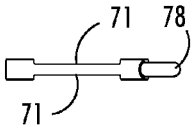
Figure 38A:
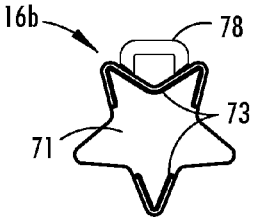
FIGS. 38A-38D are a plan, a perspective, and elevational views of a star-shaped pendant.
Figure 38B:
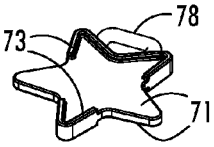
Figure 38C:
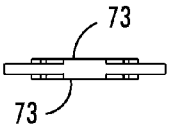
Figure 38D:
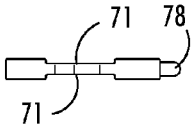
Figure 39A:
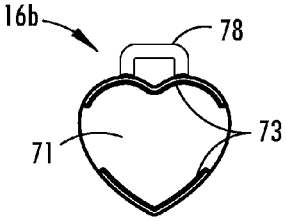
FIGS. 39A-39D are a plan, a perspective, and elevational views of a heart-shaped pendant.
Figure 39B:
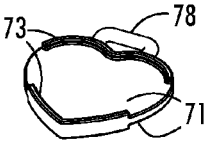
Figure 39C:
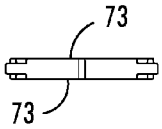
Figure 39D:
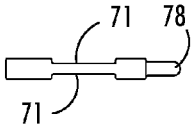
Figure 40A:
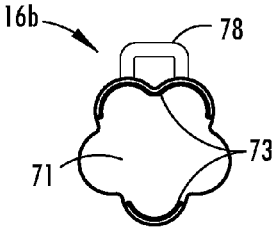
FIGS. 40A-40D are a plan, a perspective, and elevational views of a flower-shaped pendant.
Figure 40B:
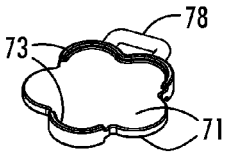
Figure 40C:
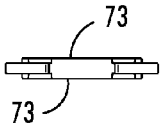
Figure 40D:
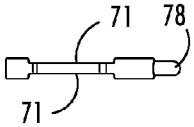
Figure 41A:
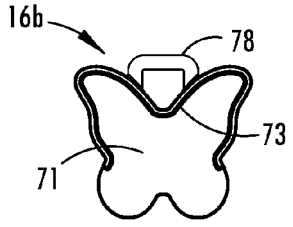
FIGS. 41A-41D are a plan, a perspective, and elevational views of a butterfly-shaped pendant.
Figure 41B:
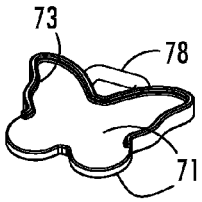
Figure 41C:
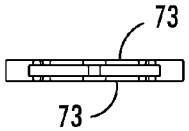
Figure 41D:
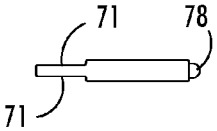
Figure 42A:
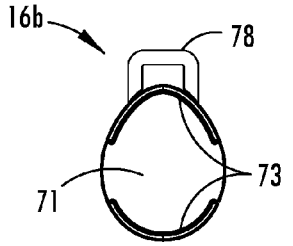
FIGS. 42A-42D are a plan, a perspective, and elevational views of an egg-shaped pendant.
Figure 42B:
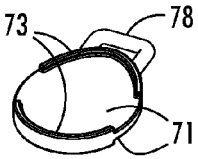
Figure 42C:
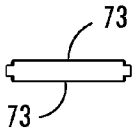
Figure 42D:
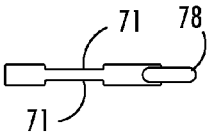
Figure 43A:
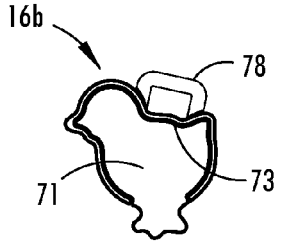
FIGS. 43A-43D are a plan, a perspective, and elevational views of a chick-shaped pendant.
Figure 43B:
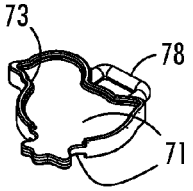
Figure 43C:
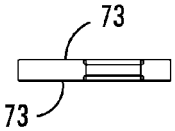
Figure 43D:
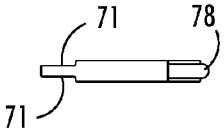
Figure 44A:
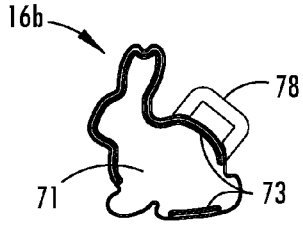
FIGS. 44A-44D are a plan, a perspective, and elevational views of a bunny-shaped pendant.
Figure 44B:
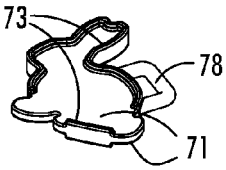
Figure 44C:
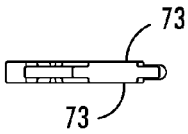
Figure 44D:
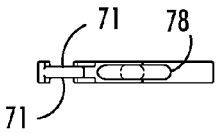
Figure 45A:
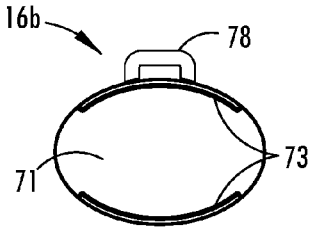
FIGS. 45A-45D are a plan, a perspective, and elevational views of an oval-shaped pendant.
Figure 45B:
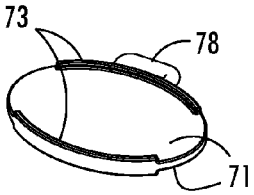
Figure 45C:
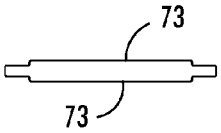
Figure 45D:
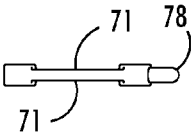

An additional type of decorative piece, namely hangers 70, 72 are shown in FIGS. 25-35, whereby a base portion 74 substantially surrounds the strap 12 and a hook feature 76 extends from the base portion 74 of the hanger, such as to support a loop 78 of the pendant 16*b* or tassel 16*d* or the like. In one illustrated example, the hanger 70 of FIGS. 25-29 provides a straight hanger arrangement with the hook feature 76 protruding parallel to the width of the elongated strap 12. In another illustrated example, the hanger 72 of FIGS. 30-35 provides a T-hanger arrangement with the hook feature 76 protruding perpendicularly from the width and length of the elongated strap 12. The illustrated base portion 74 of the hangers 70, 72 includes an opening 80 with a pair of engagement detents 82 protruding from respective opposing interior sides of the in opening, which allows the strap's catch features to engage either side of the base portion 74 and thereby allows the base portion to be engaged by the strap in multiple orientations. The lateral interior sides of the opening 80 function to retain the edge portions of an intermediate section of the elongated strap, such as shown in FIGS. 27A and 32A. When engaging the strap, the upper surface of the strap 12, may be engaged by one engagement detent 82 that is shaped similar to the detent portion 32 of the engagement element 20. Accordingly, the charm may be slidably moved relative to the length of the elongated strap 12, allowing the detent 82 to engage the elongated strap 12 at various locations along its length. Although provided with a similar shape as the detent portion 32, the detent 82 on the hanger may not have the same resiliency and may not have the same tactile engagement when moved along the strap 12. The loop configuration may also be size adjustable with the hanger attached to the strap 12, although such movement may be slighted restricted when the hanger is engaged at the section of the strap 12 immediately adjacent to the retainer 14.

As shown in FIGS. 37A-45D, a variety of different shaped pendants 16*b* are illustrated. For example, these shapes may be provided in a kit with the size-adjustable fashion accessory to coordinate with a theme or target audience, such as a holiday theme, a seasonal theme, a sport theme, a television character theme, or the like. For example, a Halloween theme may include cat, ghost, witch, pumpkin, and/or bat shaped pendants and a Christmas theme may include Santa, snowman, Christmas tree, and/or gingerbread man shaped pendants. Each of these pendants 16*b* have a loop feature 78 for engaging the hangers and two face surfaces on opposing sides for each receiving a sticker or the like. The face surfaces 71 are at least partially bordered by a raised lip 73 that protrudes slightly away from the face surface to function to assist a user with aligning such a sticker when applying them to the face surface. The raised lips 73 of each pendant are not continuous around the face surface 71 so as to provide at least two open areas at the periphery of the face surface. The open areas allow edges of the stickers to be more readily accessed for removal of the stickers from the face surface.

Figure 46A:
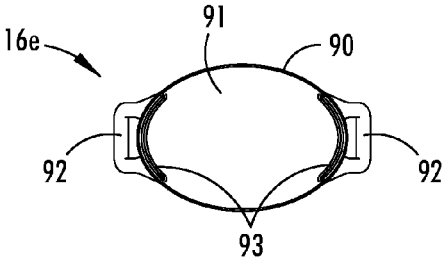
FIGS. 46A-46D are a plan, a perspective, and elevational views of an buckle.
Figure 46B:
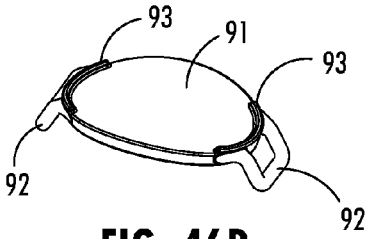
Figure 46C:
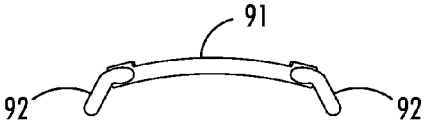
Figure 46D:
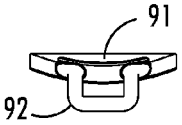
Figure 46E:
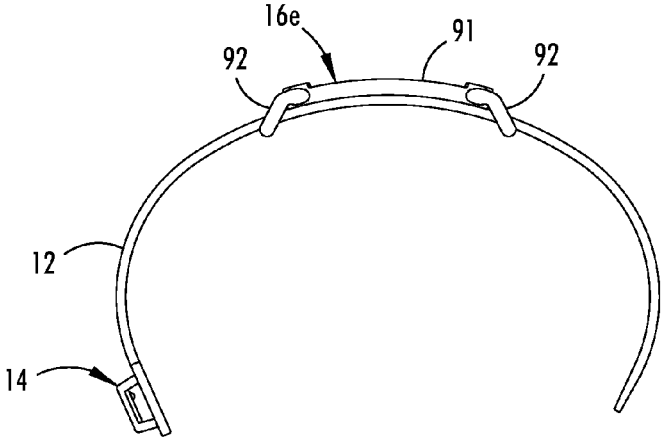
FIG. 46E is an elevational view of the buckle engaged with a strap of a size-adjustable fashion accessory.
Figure 46F:
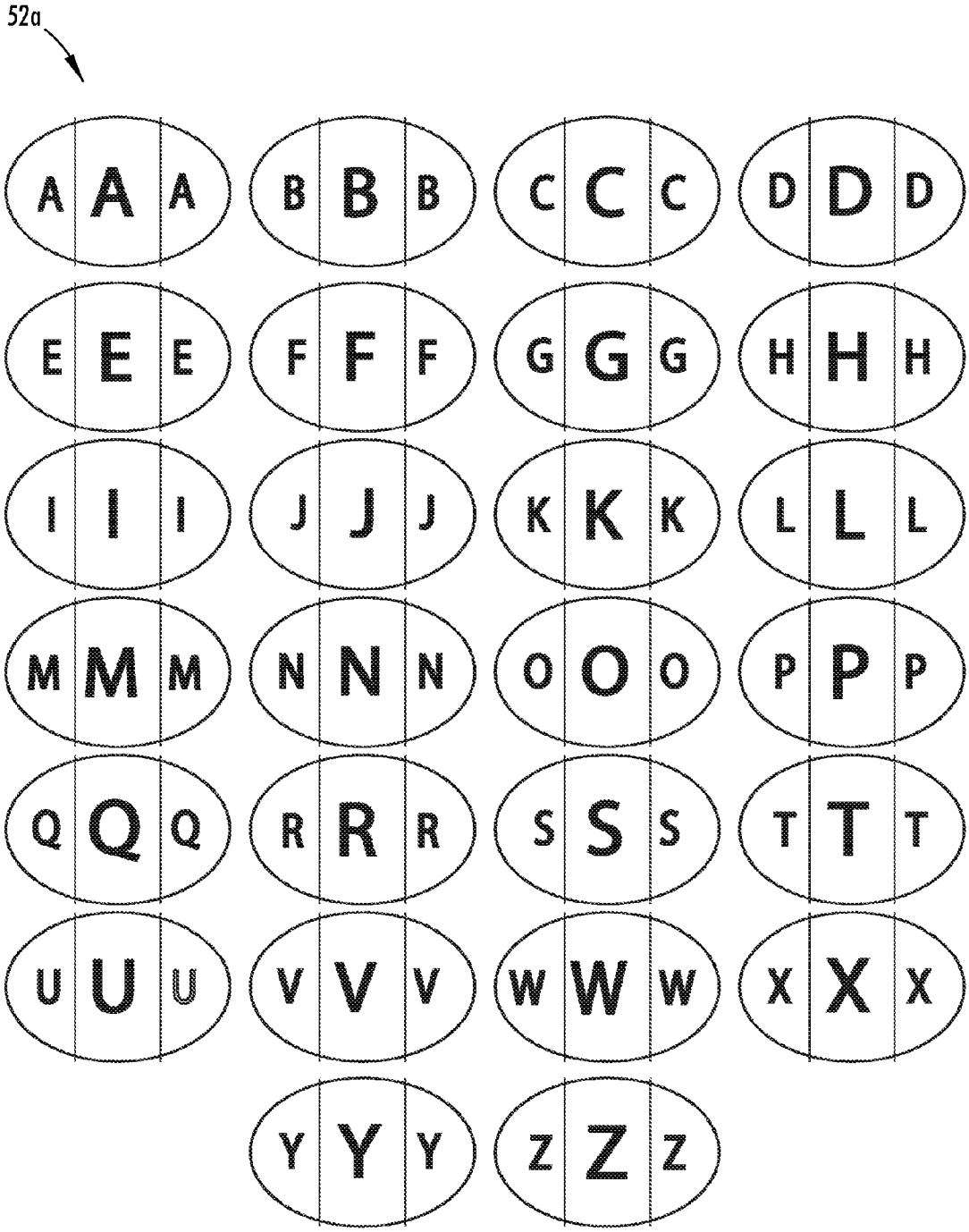
FIG. 46F is a plan view a sheet of monogram stickers that may be applied to a decorative piece of a size-adjustable fashion accessory.
Figure 47A:
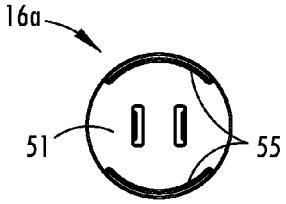
FIGS. 47A-47D are a plan, a perspective, and elevational views of an circle-shaped charm.
Figure 47B:
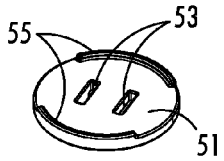
Figure 47C:
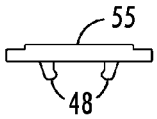
Figure 47D:
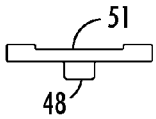
Figure 48A:
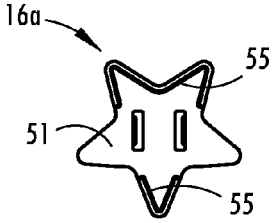
FIGS. 48A-48D are a plan, a perspective, and elevational views of a star-shaped charm.
Figure 48B:
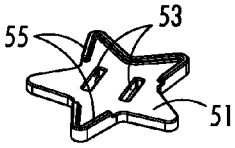
Figure 48C:
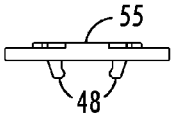
Figure 48D:
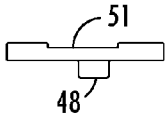
Figure 49A:
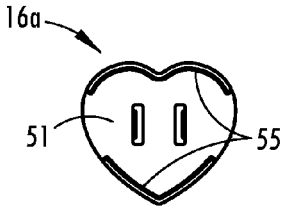
FIGS. 49A-49D are a plan, a perspective, and elevational views of a heart-shaped charm.
Figure 49B:
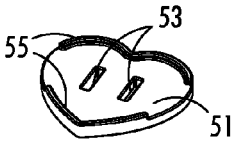
Figure 49C:
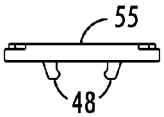
Figure 49D:
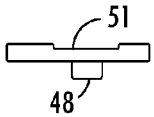
Figure 50A:
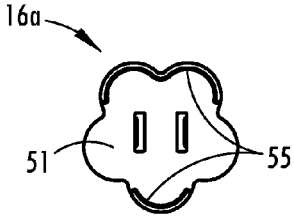
FIGS. 50A-50D are a plan, a perspective, and elevational views of a flower-shaped charm.
Figure 50B:
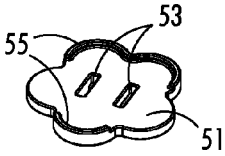
Figure 50C:
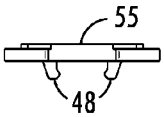
Figure 50D:
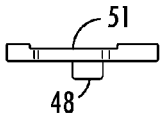
Figure 51A:
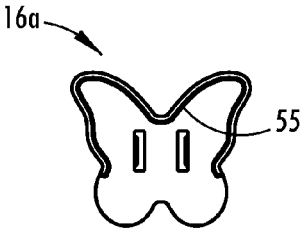
FIGS. 51A-51D are a plan, a perspective, and elevational views of a butterfly-shaped charm.
Figure 51B:
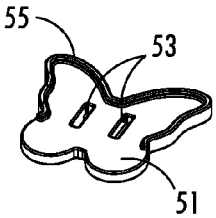
Figure 51C:
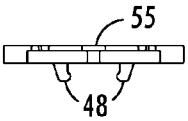
Figure 51D:
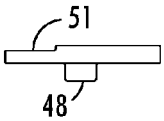
Figure 52A:
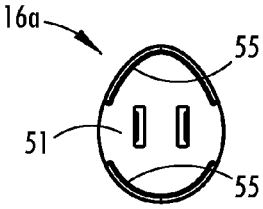
FIGS. 52A-52D are a plan, a perspective, and elevational views of an egg-shaped charm.
Figure 52B:
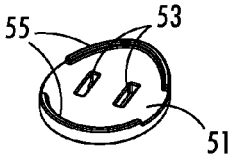
Figure 52C:
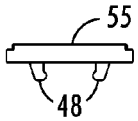
Figure 52D:
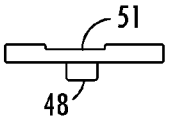
Figure 53A:
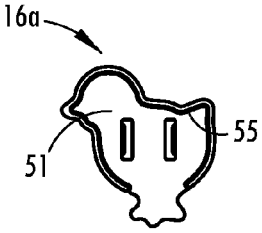
FIGS. 53A-53D are a plan, a perspective, and elevational views of a chick-shaped charm.
Figure 53B:
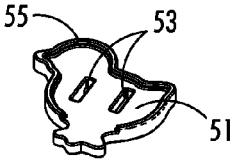
Figure 53C:
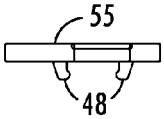
Figure 53D:
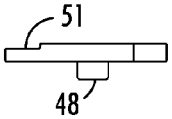
Figure 54A:
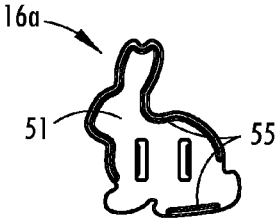
FIGS. 54A-54D are a plan, a perspective, and elevational views of a bunny-shaped charm.
Figure 54B:
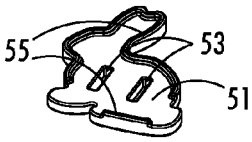
Figure 54C:
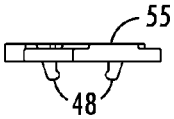
Figure 54D:
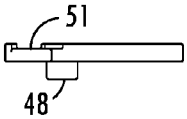
Figure 55:
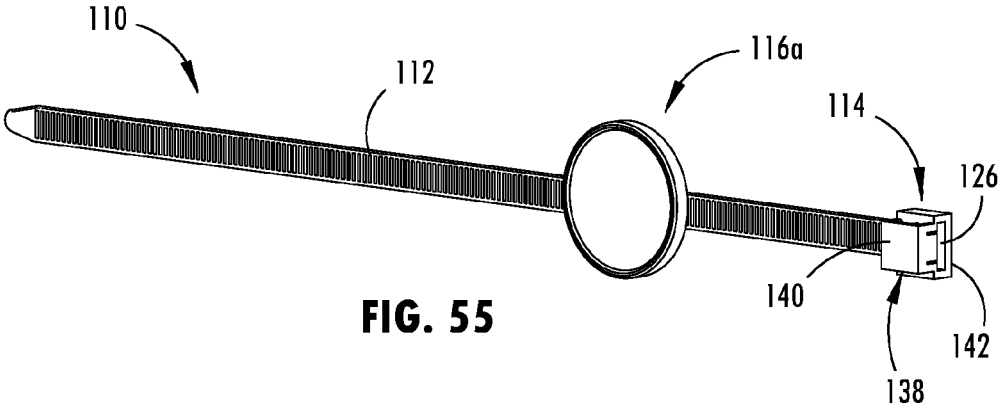
FIG. 55 is an upper perspective view of a size-adjustable fashion accessory having an additional embodiment of a retainer.
Figure 56:
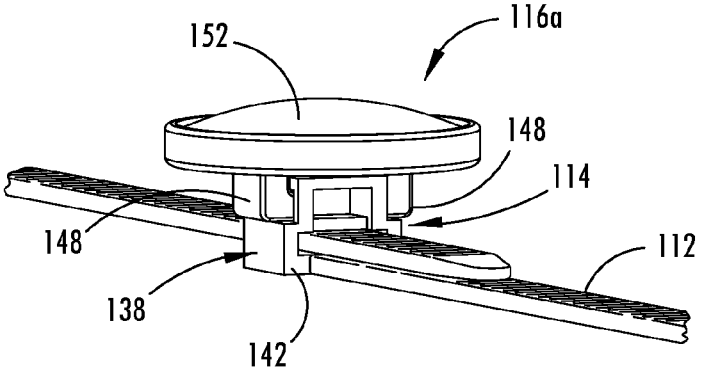
FIG. 56 is an upper perspective view of the size-adjustable fashion accessory shown in FIG. 55, having a charm engaged with the retainer.

Similar to the pendants 16*b*, a buckle 16*e* is shown in FIGS. 46A-46E that provides a generally curved body portion 90, such as to conform to the a wearer's wrist, such that the face surface 91 at the body portion is also curved outward and bordered partially by a raised lip 93. On opposing sides of the curved buckle, loop features 92 are also provided for engaging a strap of the size-adjustable fashion accessory and/or to engaging hanger accessories or the like. For example, as shown in FIG. 46E, the loop features 92 of buckle 16*e* are both engaged with an intermediate section of a strap 12 of a size-adjustable fashion accessory. Further, as shown in FIG. 46F, an exemplary sticker sheet is illustrated that provides a sheet of customizable monogram stickers 52*a* that may be applied to a decorative piece of a size-adjustable fashion accessory. More specifically, the illustrated monogram stickers provide three character locations (left, middle, right) and all English letters for each character location, such that any conceivable three letter monogram arrangement can be created with these stickers and easily applied to one of the decorative pieces, such as the buckle 16*e*. However, it is contemplated that other stickers and sticker sheets and the like can be provided to customize a size-adjustable fashion accessory.

Further, charms 16*a* with various different exemplary shapes are shown in FIGS. 47A-54D, where each charm 16*a* has a shape defining a face surface 51 that receives the correspondingly shaped sticker or the like. Like the pendants, these shapes may be provided in a kit with the size-adjustable fashion accessory to coordinate with a theme or target audience, such as a holiday theme, a seasonal theme, a sport theme, a television character theme, or the like. For example, a Halloween theme may include cat, ghost, witch, pumpkin, and/or bat shaped charms and a Christmas theme may include Santa, snowman, Christmas tree, and/or gingerbread man shaped charms. Each of these charm have legs 48 with inward extending features 56 at the lower end portions of the legs 48, so that the legs may attach at the strap portion or the retainer portion of the size-adjustable fashion accessory. The face surfaces 51 are also bordered by a raised lip 55 that protrudes slightly away from the face surface to function to assist a user with aligning such a sticker when applying them to the face surface. The raised lips of each charm are not continuous around the face surface so as to provide at least two open areas at the periphery of the face surface. These open areas also allow edges of the stickers to be more readily accessed for removal of the stickers from the face surface.

Figure 57:
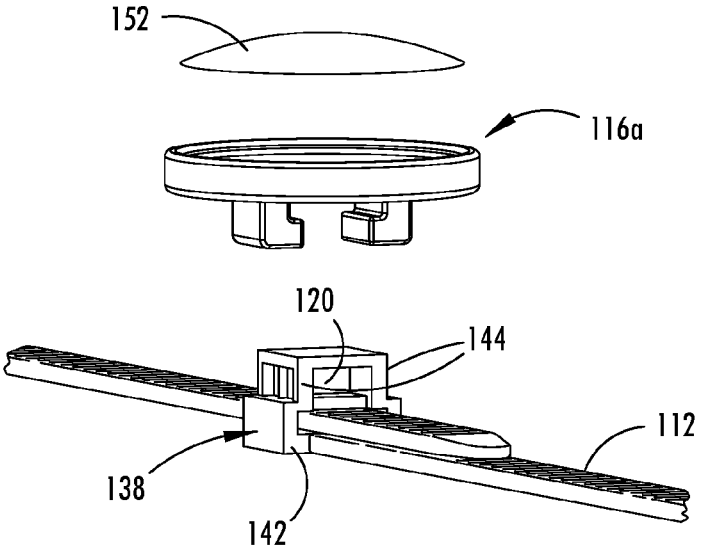
FIG. 57 is an exploded upper perspective view of the size-adjustable fashion accessory and charm shown in FIG. 56.
Figure 58:
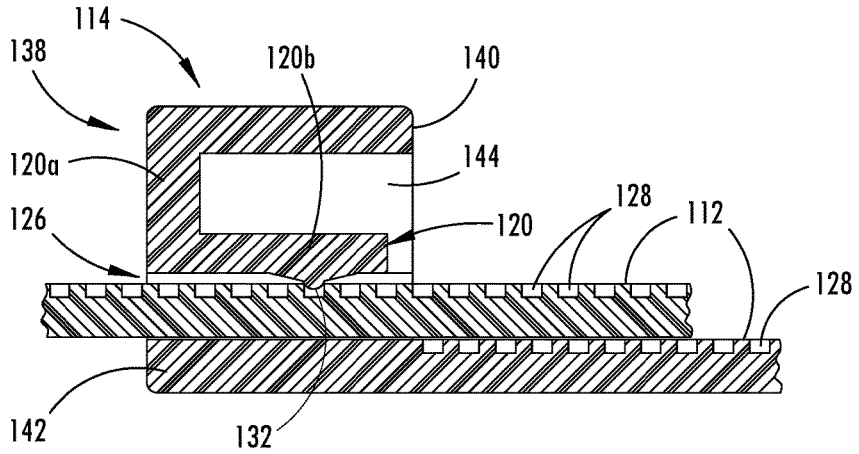
FIG. 58 is a cross-sectional view of the retainer engaged with a band portion of the size-adjustable fashion accessory shown in FIG. 56 taken along the length of the band portion.
Figure 59:
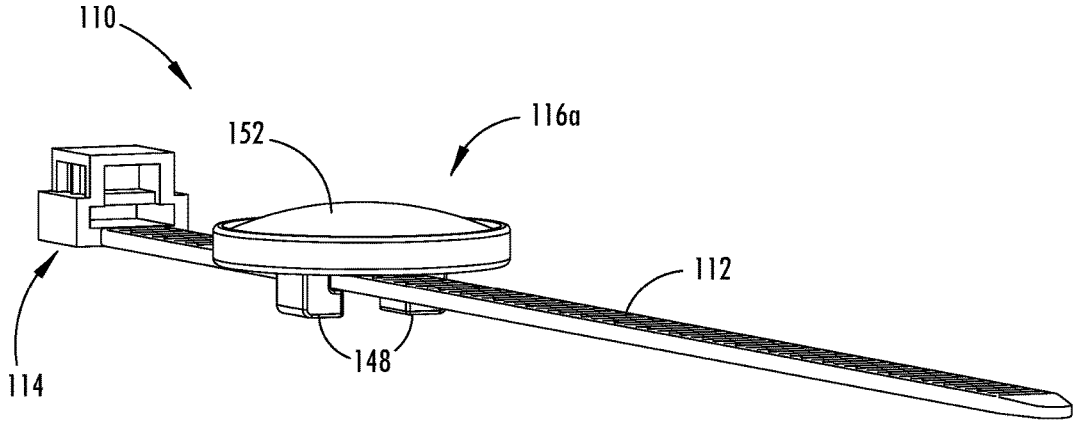
FIG. 59 is an upper perspective view of a size-adjustable fashion accessory and engaged charm shown in FIG. 55.
Figure 60:
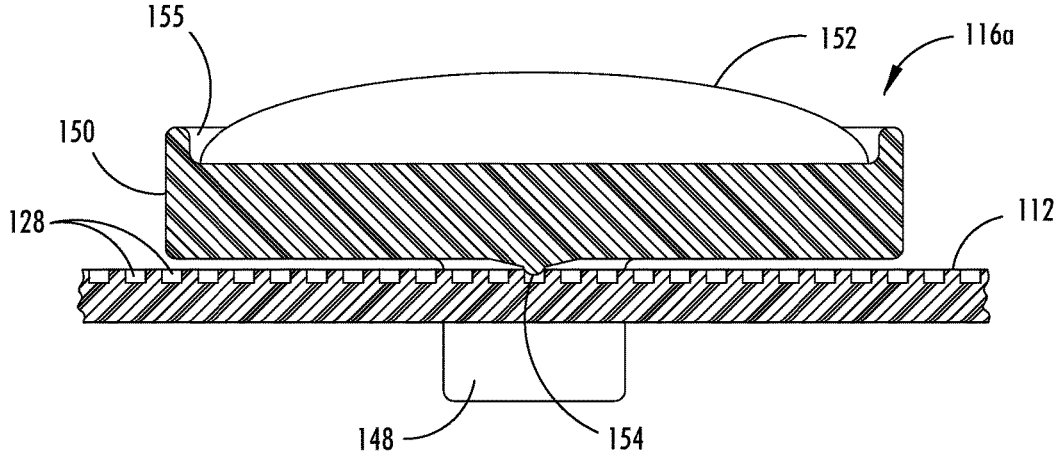
FIG. 60 is a cross-sectional view of the charm shown in FIG. 59, taken along the length of the band portion of the size-adjustable fashion accessory.

Referring now to FIGS. 55-61, an additional embodiment of the size-adjustable fashion accessory 110 is shown that provides a retainer 114 having a housing structure 138 with an upper wall 140 spaced from a lower or base wall 142 to define the passage 126 that is configured to receive the elongated strap 112 to form the loop configuration. The lower or base wall 142 of the illustrated housing structure 138 is generally aligned with the longitudinal extent of the elongated strap 112, such that the end section of the strap 112 may overlay the section of the strap adjacent to the retainer 114, such as shown in FIG. 59. The upper wall 140 of the illustrated housing structure 142 is supported a spaced distance away from the lower wall 142 by side walls 144 (FIG. 57) that extend between the upper and lower walls 140, 142 on opposing sides of the passage 126 (FIG. 58).

The illustrated passage 126 is thereby surrounded by the upper, lower, and sidewalls of the housing structure 138. The engagement element 120 protrudes downward from the upper wall 140 into the passage 126. To allow for increased flexibility of the engagement element 120, the engagement element 120 is not attached at either side wall 144 of the housing structure 138, as shown in FIG. 57.

Further, as shown in FIG. 58, the engagement element 120 protrudes down from an end of the upper wall 140 in an L-shape, having a short arm 120*a* extending orthogonally down from the upper wall 140 and a long arm 120*b* extending from the short arm 120*a* in general alignment with the lower wall 142 of the housing 138. The detent portion 132 of the engagement element 120 is shown protruding down from a lower surface of the long arm 120*b*, such that movement of the detent portion 132 into and out of the cavities 128 causes the engagement element 120 to flex along its L-shape and about its connection at the upper wall 140. Optionally, the engagement element may protrude down from an opposite end of the upper wall and may have additional shapes and configurations to provide the flexible and resilient movement of the detent portion into and out of engagement with the catch features. It is envisioned that a tensile force of at least approximately 5 to 10 lbf is desirable to adjust the position of the elongated strap 112 relative to retainer 114. Accordingly, the amount of required force can, for example, be adjusted or altered as desired by changing the configuration, shape, thickness, and/or material that forms the catch features and/or engagement element.

Figure 61:
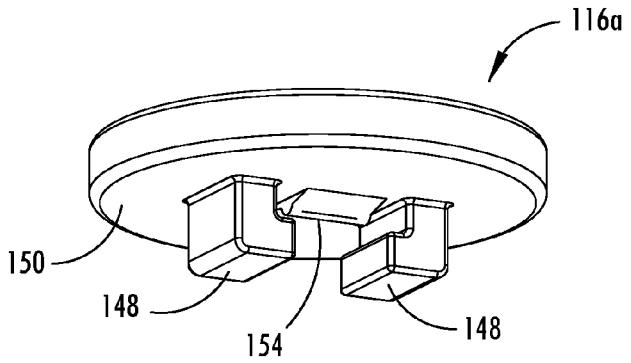
FIG. 61 is a lower perspective view of the charm shown in FIG. 59.
Figure 62:
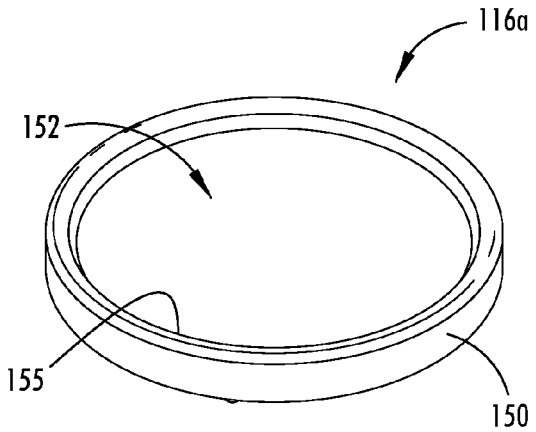
FIG. 62 is an upper perspective view of the charm shown in FIG. 61.
Figure 62A:
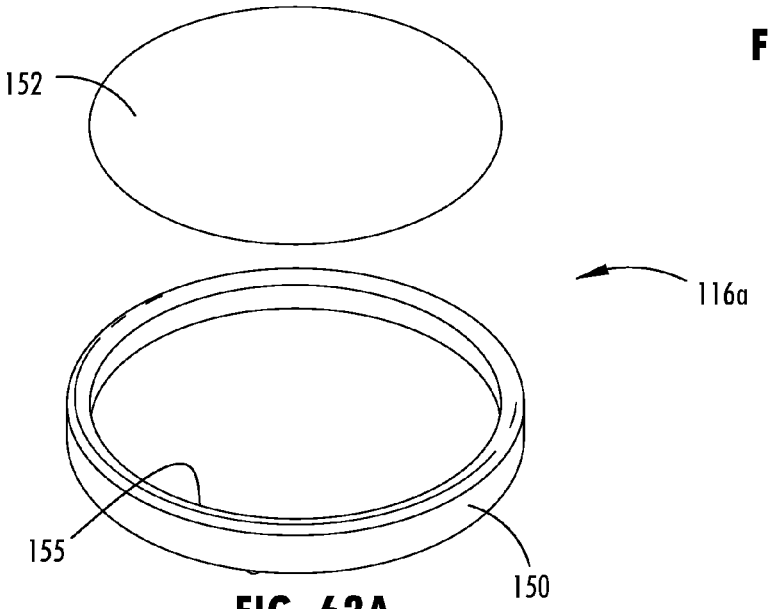
FIG. 62A is an exploded upper perspective view of the charm shown in FIG. 62.

As shown in FIGS. 59-62A, an additional embodiment of the decorative piece 116 is illustrated. Specifically, the base portion 150 of the charm 116*a* is shown having an engagement detent 154 protruding from the bottom surface and extending between the legs 148. As shown in FIG. 61, the legs 148 have inward extending features 156 at the lower end portions of the legs 148. The inward extending features 156 may function to both engage the retainer 14, such as shown in FIG. 59, and to engage the edge portions of an intermediate section of the elongated strap 12, such as shown in FIG. 20. When engaging the strap, the inward extending features 56 of the legs engage both the side surface of the strap 12 and the lower surface along the edge of the strap 12, while the engagement detent 154 engages the upper surface or catch features 118 on the strap 112. The engagement detent 154 that is shaped similar to the detent portion 32 of the engagement element 20. Accordingly, the charm 116*a* may be slidably moved relative to the length of the elongated strap, allowing the detent 154 to engage the elongated strap at various locations along its length. Although provided with a similar shape as the detent portion 32, the detent 154 on the charm 116*a* may not have the same resiliency and may not have the same tactile engagement when moved along the strap. The loop configuration may also be size adjustable with the charm attached to the strap 112, as long as the charm is not engaged at the section of the strap immediately adjacent to the retainer.

Accordingly, the size-adjustable fashion accessory 10, 110 includes an elongated strap having catch features, such as raised or depressed features, disposed at spaced locations along a length of the elongated strap 12, 112 to be engaged by a retainer 14, 114 that is disposed at an end section of the elongated strap. The retainer receives the end section of the elongated strap to form a size-adjustable loop configuration, which may be worn as a bracelet or necklace or the like. The retainer 14, 114 includes an engagement element 20, 120 that resiliently deforms or flexes or moves away from the elongate strap upon insertion and removal of the end section into and from the retainer, and also resiliently returns to or moves toward the elongated strap to engage at least one of the plurality of catch features. Hence, the engagement element provides tactile engagement and feedback, such as a click or snap, when adjusting the size of the loop configuration and allows the elongated strap to be completely removed from the retainer and reengaged in the loop configuration at a later time. Further, the size-adjustable fashion accessory may include one or more decorative pieces that can engage the elongated strap at various locations along its length and/or at the retainer 14, 114 to customize the fashion accessory 10, 110 as desired. As such, the size-adjustable fashion accessory and associated decorative pieces are designed in a manner that is easy to use, adjust, and customize for individuals with poor or developing dexterity, such as children, who enjoy creating unique and customizable fashion accessories to wear as jewelry and/or decorate shoes and knapsacks and the like.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A size-adjustable fashion accessory, comprising:

an elongated strap having a plurality of catch features disposed at spaced locations along a length of the elongated strap;

a retainer disposed at a first end section of the elongated strap that is configured to receive an opposing second end section of the elongated strap to form a loop configuration;

wherein the retainer includes an engagement element that resiliently moves away from the elongated strap solely upon insertion and removal of the second end section relative to the retainer and resiliently moves toward the elongated strap to engage at least one of the plurality of catch features; and wherein the engagement element provides a tactile engagement for adjustably holding the elongated strap in the loop configuration and allows the elongated strap to be completely removed from the retainer and reengaged in the loop configuration.

2. The size-adjustable fashion accessory of claim 1, wherein, after forming the loop configuration, the loop configuration is adjustable to a larger size by partially withdrawing the elongated strap from the retainer, such that the engagement element elastically deforms to allow at least one of the plurality of catch features to move past the retainer and resiliently reengages another one of the plurality of catch features.

3. The size-adjustable fashion accessory of claim 1, wherein the plurality of catch features each include a cavity that is sized to receive an end portion of the engagement element.

4. The size-adjustable fashion accessory of claim 1, wherein the retainer includes an attachment feature adapted to engage a decorative piece, wherein the loop configuration is size adjustable with the decorative piece attached at the retainer.

5. The size-adjustable fashion accessory of claim 1, wherein the retainer includes a housing with an upper member spaced from a lower member to define a passage that is configured to receive the second end section of the elongated strap to form the loop configuration.

6. The size-adjustable fashion accessory of claim 5, wherein the lower member of the housing is generally aligned with the length of the elongated strap, such that the second end section overlays the first end section of the elongated strap in the loop configuration.

7. The size-adjustable fashion accessory of claim 6, wherein the plurality of catch features are disposed on an outer surface of the elongated strap and the engagement element protrudes from the upper member into the passage defined by the housing to engage the outer surface of the elongated strap.

8. The size-adjustable fashion accessory of claim 1, further comprising a decorative piece having a base portion adapted to engage the elongated strap at various locations along a length of the strap.

9. The size-adjustable fashion accessory of claim 1, further comprising a decorative piece having a base portion that engages the elongated strap and is slidable along the length of the elongated strap, wherein the base portion includes an engagement detent that resiliently deforms against at least one of the plurality of catch features upon slidably moving the base portion relative to the length of the elongated strap.

10. A size-adjustable fashion accessory, comprising:

an elongated strap having a plurality of raised or depressed features disposed at spaced locations along a length of the elongated strap;

a retainer disposed at a first end portion of the elongated strap that includes (i) a housing that defines a passage through the housing that is configured to receive an opposing second end portion of the elongated strap to form a loop configuration and (ii) an engagement element that is arranged to interface with at least one of the plurality of raised or depressed features for holding the elongated strap in the loop configuration; and wherein, after forming the loop configuration, the loop configuration is adjustable to a larger size by withdrawing the elongated strap from the housing, such that at least one of the engagement element and the raised or depressed features resiliently deforms to allow the second end portion of the elongated strap to adjustably move into and out of the housing.

11. The size-adjustable fashion accessory of claim 10, wherein, by adjusting the loop to a larger size, the engagement element deforms to allow at least one of the plurality of raised or depressed features to move past the retainer and resiliently reengages another one of the plurality of raised or depressed features, providing a snapping tactile engagement.

12. The size-adjustable fashion accessory of claim 11, wherein the housing includes an attachment feature adapted to engage a decorative piece, wherein the loop is size adjustable with the decorative piece attached at the retainer.

13. The size-adjustable fashion accessory of claim 10, wherein the housing includes an upper member spaced from a lower member to define the passage that is configured to receive the second end portion of the elongated strap to form the loop.

14. The size-adjustable fashion accessory of claim 13, wherein the lower member of the housing is generally aligned with a longitudinal extent of the elongated strap, such that the second end portion overlays the first end portion of the elongated strap when engaged with the housing.

15. The size-adjustable fashion accessory of claim 14, wherein the plurality of raised or depressed features are disposed on an outer surface of the elongated strap and the engagement element protrudes from the upper member of the housing into the passage.

16. The size-adjustable fashion accessory of claim 15, further comprising a decorative piece having a base portion that engages the elongated strap and is slidable along the length of the elongated strap.

17. The size-adjustable fashion accessory of claim 16, wherein the base portion includes an engagement detent that resiliently deforms against at least one of the plurality of raised or depressed features upon slidably moving relative to the length of the elongated strap.

18. A fashion accessory kit, comprising:

a size-adjustable strap having a plurality of catch features disposed at spaced locations along a length of the strap and a retainer disposed at a first end section of the strap that is configured to receive an opposing second end section of the strap to form a loop configuration;

wherein the retainer includes an engagement element that resiliently engages at least one of the plurality of catch features and moves to disengage the plurality of catch features solely upon insertion and removal of the size-adjustable strap into and from the retainer, providing a tactile engagement when adjusting a size of the loop configuration;

a plurality of decorative pieces adapted to selectively engage at least one of the retainer and a location along a length of the strap; and wherein at least one of the plurality of decorative pieces includes a face surface adapted to receive an ornamental sticker.

19. The fashion accessory kit of claim 18, wherein the plurality of decorative pieces includes a charm adapted to selectively engage the retainer, a hanger adapted to selectively engage a location along the length of the strap, and a pendant adapted to engage a hook portion of the hanger.

20. The size fashion accessory kit of claim 18, wherein the plurality of catch features each include a cavity that is sized to receive an end portion of the engagement element.

* * * * *